US010828799B2

(12) United States Patent
Kim et al.

(10) Patent No.: US 10,828,799 B2
(45) Date of Patent: Nov. 10, 2020

(54) ATYPICAL MOLDED BODY MANUFACTURING DEVICE, MOLDING MATERIAL CASTING FORM USING SAME, AND ROD-TYPE MOLD

(71) Applicant: University-Industry Cooperation Group of Kyung Hee University, Yongin-Si (KR)

(72) Inventors: Sun Kuk Kim, Yongin-Si (KR); Won Kee Hong, Yongin-Si (KR)

(73) Assignee: UNIVERSITY-INDUSTRY COOPERATION GROUP OF KYUNG HEE UNIVERSITY, Yongin-Si (KR)

( * ) Notice: Subject to any disclaimer, the term of this patent is extended or adjusted under 35 U.S.C. 154(b) by 365 days.

(21) Appl. No.: 15/504,741

(22) PCT Filed: Jun. 24, 2015

(86) PCT No.: PCT/KR2015/006448
§ 371 (c)(1),
(2) Date: Feb. 17, 2017

(87) PCT Pub. No.: WO2016/027975
PCT Pub. Date: Feb. 25, 2016

(65) Prior Publication Data

US 2017/0259455 A1 Sep. 14, 2017

(30) Foreign Application Priority Data

Aug. 19, 2014 (KR) ..... 10-2014-0107580
Aug. 19, 2014 (KR) ..... 10-2014-0107581
(Continued)

(51) Int. Cl.
*B28B 1/14* (2006.01)
*B28B 7/02* (2006.01)
*B28B 7/06* (2006.01)

(52) U.S. Cl.
CPC ..... *B28B 1/14* (2013.01); *B28B 7/02* (2013.01); *B28B 7/025* (2013.01); *B28B 7/06* (2013.01)

(58) Field of Classification Search
CPC .. B28B 1/14; B28B 7/025; B28B 7/02; B28B 7/06
See application file for complete search history.

(56) References Cited

U.S. PATENT DOCUMENTS 3,286,621 A * 11/1966 Martin, Jr. ..... B30B 9/3007 100/45
5,187,969 A * 2/1993 Morita ..... B21D 53/886 29/896.91
5,546,784 A * 8/1996 Haas ..... B21D 37/02 72/413

FOREIGN PATENT DOCUMENTS

JP 08-164513 A 6/1996
KR 20-0321364 Y1 7/2003
(Continued)

OTHER PUBLICATIONS

Machine Translation of Kim et al. "The Manufacturing Apparatus for Free-Form Concrete Segment" KR-10-1422753 (B1), published Jul. 23, 2014, retrieved Jan. 10, 2019 from worldwide.espacenet.com (Year: 2014).*
(Continued)

*Primary Examiner* — Michael M. Robinson
(74) *Attorney, Agent, or Firm* — Panitch Schwarze Belisario & Nadel LLP

(57) ABSTRACT

An atypical-molded-body manufacturing device according to the present invention comprises at least one shape output
(Continued)

unit comprising a plurality of movable rods provided to be able to move up and down and arranged along a first direction. A driving module transfers a driving force to the movable rods, thereby moving each of the plurality of movable rods to a predetermined height. An atypical curvature is formed by a difference in level configured by the upper end of each of the plurality of movable rods that have moved to the predetermined height.

11 Claims, 29 Drawing Sheets

(30) Foreign Application Priority Data

Aug. 19, 2014 (KR) ..... 10-2014-0107582
Jun. 22, 2015 (KR) ..... 10-2015-0088537

(56) References Cited

FOREIGN PATENT DOCUMENTS

| | | | |
|---|---|---|---|
| KR | 10-1206517 | B1 | 11/2012 |
| KR | 10-1422753 | B1 | 7/2014 |
| KR | 10-1426734 | B1 | 8/2014 |

OTHER PUBLICATIONS

Int'l Search Report dated Oct. 7, 2015 in Int'l Application No. PCT/KR2015/006448 (English Translation).

* cited by examiner

ATYPICAL MOLDED BODY MANUFACTURING DEVICE, MOLDING MATERIAL CASTING FORM USING SAME, AND ROD-TYPE MOLD

CROSS-REFERENCE TO RELATED APPLICATIONS

This application is a Section 371 U.S. National Stage Filing of International Application No. PCT/KR2015/006448, filed Jun. 24, 2015, which was published in the Korean language on Feb. 25, 2016, under International Publication No. WO 2016/027975 A1, which claims priority to Korean Patent Application No. 10-2015-0088537, filed on Jun. 22, 2015, Korean Patent Application No. 10-2014-0107580, filed on Aug. 19, 2014, Korean Patent Application No. 10-2014-0107581, filed on Aug. 19, 2014, and Korean Patent Application No. 10-2014-0107582, filed on Aug. 19, 2014, the disclosures of which are incorporated herein by reference.

TECHNICAL FIELD

The present invention relates to a manufacturing device for manufacturing an atypical molded body, a molding material casting form using the device, and a rod-type mold. More particularly, the present invention relates to an atypical-molded-body manufacturing device capable of manufacturing an atypical molded body using atypical curvature expressed by a plurality of movable rods, a molding material casting form using the device, and a rod-type mold.

BACKGROUND ART

Recently, with the artistic demands of a designer and an owner and technical development, the construction of an atypical molded body including atypical concrete whose section is a free curve is increasing.

Although the atypical concrete offers beautiful appearance, a casting form is not recycled and it takes a long time to manufacture. Thus, it is disadvantageous in terms of economic efficiency. Therefore, the construction of the atypical molded body is currently avoided on a site.

Further, even if the atypical-concrete construction is performed, a method of rapidly manufacturing the atypical concrete in batches is not developed yet, so that the casting form is manually produced on a site or in a factory. Thus, the manufacturing cost of the casting form is three to five times as high as the cost by an existing construction method. Further, the manufacturing cost as well as labor cost is significantly being increased.

Moreover, the above-described method is problematic in that distorted designs may be frequently obtained to be different from the beautiful curved lines as it is in the design drawing due to the difficulty of manufacturing, the quality of a product depends on the skill of workers, and, above all, it is difficult to calculate and reduce a construction period. Thus, the construction period may be undesirably increased indefinitely depending on the site conditions.

Therefore, methods for solving these problems are required.

DISCLOSURE

Technical Problem

The present invention has been made in an effort to solve the above-described problems associated with prior art. An object of the present invention is to easily and quickly manage a device for manufacturing an atypical molded body and to reduce manufacturing cost.

Another object of the present invention is to rapidly manufacture an atypical molded body via a computer program and a control device, by directly converting a design drawing into figures without the necessity of separately modeling the design drawing.

The objects of the present invention are not limited to the above-mentioned objects, and other objects that are not mentioned herein will be clearly understood by those skilled in the art from the following description.

Technical Solution

In order to accomplish the above object, the present invention provides an atypical-molded-body manufacturing device, including at least one shape output unit including: a plurality of movable rods provided to be movable up and down, and arranged along a first direction; and a driving module transferring a driving force to the movable rods, thereby moving each of the plurality of movable rods to a predetermined height, whereby atypical curvature is formed by a difference in level configured by the upper end of each of the plurality of movable rods that have moved to the predetermined height.

The shape output unit may comprise a plurality of shape output units, and the plurality of shape output units may be arranged in a second direction that may be perpendicular to the first direction.

Further, threads may be spirally formed on a circumferential surface of each of the movable rods, and the driving module may include a main gear provided to pass through the movable rod and having threads formed to correspond to the threads of the movable rod; and a main actuator transferring a driving force to rotate the main gear, thus moving the movable rod up and down.

The driving module may further include an auxiliary gear provided between a pair of neighboring main gears, and an auxiliary actuator moving the auxiliary gear to cause the auxiliary gear to optionally engage with the main gear.

Further, the main actuator may transfer the driving force to any one among the main gears located at the outermost side.

The driving module may further include an auxiliary gear provided to correspond to the main gear; an auxiliary actuator moving the auxiliary gear to cause the auxiliary gear to optionally engage with the corresponding main gear; and a gear bar engaging with the auxiliary gear while simultaneously engaging with the main gear, and the main actuator may rotate the gear bar, thus transferring the driving force to the main gear.

The atypical-molded-body manufacturing device may further include a fixing member that may fix the movable rod to prevent the movable rod from being rotated.

The atypical-molded-body manufacturing device may further include a first sensor provided on an upper portion of each of the movable rods to detect a height of the movable rod and limiting a lowest height of the movable rod; and a second sensor provided on a lower portion of each of the movable rods to detect the height of the movable rod and limiting a highest height of the movable rod.

The atypical-molded-body manufacturing device may further include a frame through which the plurality of movable rods pass, and the frame has a through hole formed to guide each of the movable rods and fixes the driving module.

The atypical-molded-body manufacturing device may further include a deformation pad seated on the shape output unit, formed to have flexibility, and deformed as the movable rods move up and down, thus defining curvature.

The atypical-molded-body manufacturing device may further include a cap member provided on the upper end of each of the movable rods and increasing a contact surface with the deformation pad.

The atypical-molded-body manufacturing device may further include an encoder calculating height data of each of the movable rods.

Further, in order to accomplish the above object, the present invention provides a molding material casting form for manufacturing an atypical molded body, the molding material casting form being provided on a shape output unit of an atypical-molded-body manufacturing device, the atypical-molded-body manufacturing device including at least one shape output unit including a plurality of movable rods provided to be movable up and down and arranged along a first direction; and a driving module transferring a driving force to the movable rods, thereby moving each of the plurality of movable rods to a predetermined height, whereby atypical curvature is formed by a difference in level between upper ends of the plurality of movable rods that have moved to the predetermined height, the molding material casting form including a deformation pad seated on the shape output unit, formed to have flexibility, and deformed as the movable rods move up and down, thus defining the curvature; and a molding unit having the deformation pad as a bottom and shielded at least at a side, thus defining a molding space that accommodates a molding material therein.

A molding unit, which is shielded at least at a side and has the deformation pad as a bottom to define a molding space, may be further provided on the shape output unit.

Further, a peripheral part of the deformation pad may be attached to a sidewall of the molding unit.

A movable rod located at an outermost position of the shape output unit may be provided to be adjacent to the sidewall of the molding unit.

The molding material casting form may further include a curing unit provided on a top of the molding unit to heat and cure the molding material injected into the molding space.

Furthermore, in order to accomplish the above object, the present invention provides a rod-type mold for manufacturing an atypical molded body, the rod-type mold being provided on a shape output unit of an atypical-molded-body manufacturing device, the atypical-molded-body manufacturing device including: at least one shape output unit including a plurality of movable rods provided to be movable up and down and arranged along a first direction; and a driving module transferring a driving force to the movable rods, thereby moving each of the plurality of movable rods to a predetermined height, whereby atypical curvature is formed by a difference in level between upper ends of the plurality of movable rods that have moved to the predetermined height, the rod-type mold including a plurality of auxiliary rods moved by displacement of the movable rods in response to the movable rods, and an anchoring part optionally anchoring the auxiliary rods to prevent the auxiliary rods from being moved.

Further, the anchoring part may include a first anchoring member configured such that the plurality of auxiliary rods arranged in the first direction pass there through and formed to be movable to one side, and a second anchoring member configured such that the plurality of auxiliary rods passing through the first anchoring member pass there through and formed to be movable to the other side, whereby the second anchoring member may cooperate with the first anchoring member to optionally anchor the auxiliary rods.

The anchoring part may include a first steel wire aligned to pass through between the plurality of auxiliary rods arranged in the first direction, and a second steel wire aligned to pass through between the plurality of auxiliary rods arranged in the first direction for two of the steel wires to cross against each other at each of the auxiliary rods, whereby, as both ends of the first and second steel wires may be tensioned, the auxiliary rods may be optionally anchored.

Further, the anchoring part may include a first moving member formed to be long in the first direction and formed to adjust a separation distance between the plurality of auxiliary rods arranged in the first direction, and a second moving member formed to be long in the first direction, arranged to be opposite to the first moving member and formed to adjust the separation distance between the plurality of auxiliary rods arranged in the first direction, whereby the second moving member may cooperate with the first moving member to optionally anchor the auxiliary rods.

Advantageous Effects

The manufacturing device for manufacturing the atypical molded body, the molding material casting form using the device, and the rod-type mold according to the present invention in order to solve the above-described problems have the following effects.

First, the invention is advantageous in that it has a mechanism efficient to implement a curved surface having an atypical curvature, thus offering excellent usability and allowing the device to be easily and quickly operated.

Second, the invention is advantageous in that the manufacturing cost of the device is reduced and time required for manufacturing the atypical molded body is reduced.

Third, the invention is advantageous in that it is possible to rapidly manufacture an atypical molded body via a computer program and a control device, by directly converting a design drawing into figures without the necessity of separately modeling the design drawing.

The effects of the present invention are not limited to the above-mentioned effect, and other effects that are not mentioned herein will be clearly understood by those skilled in the art from the following claims.

BEST MODE FOR THE INVENTION

Figure 1:
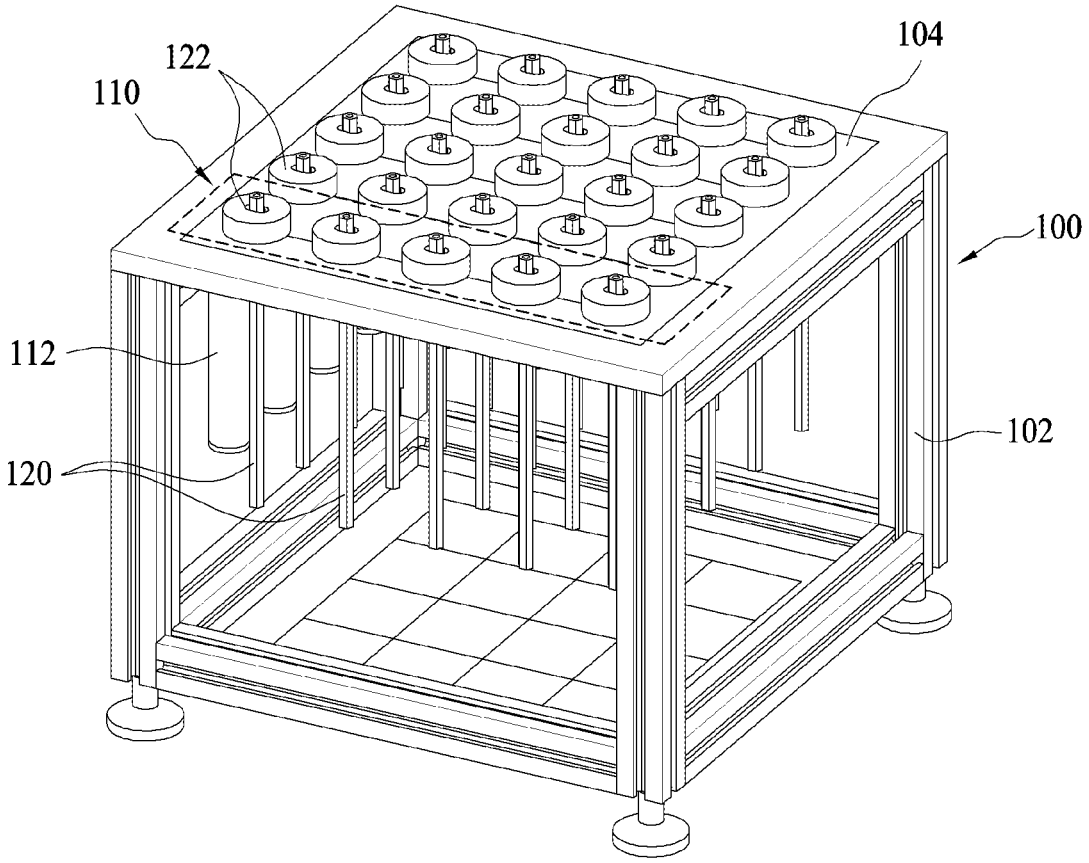
FIG. 1 is a perspective view illustrating a device for manufacturing an atypical molded body according to a first embodiment of the present invention.

Exemplary embodiments of the present invention will be described below in more detail with reference to the accompanying drawings. In the description of the embodiments, the same reference numerals are used for the same components. A detailed description of the same components will be omitted herein.

Figure 2:
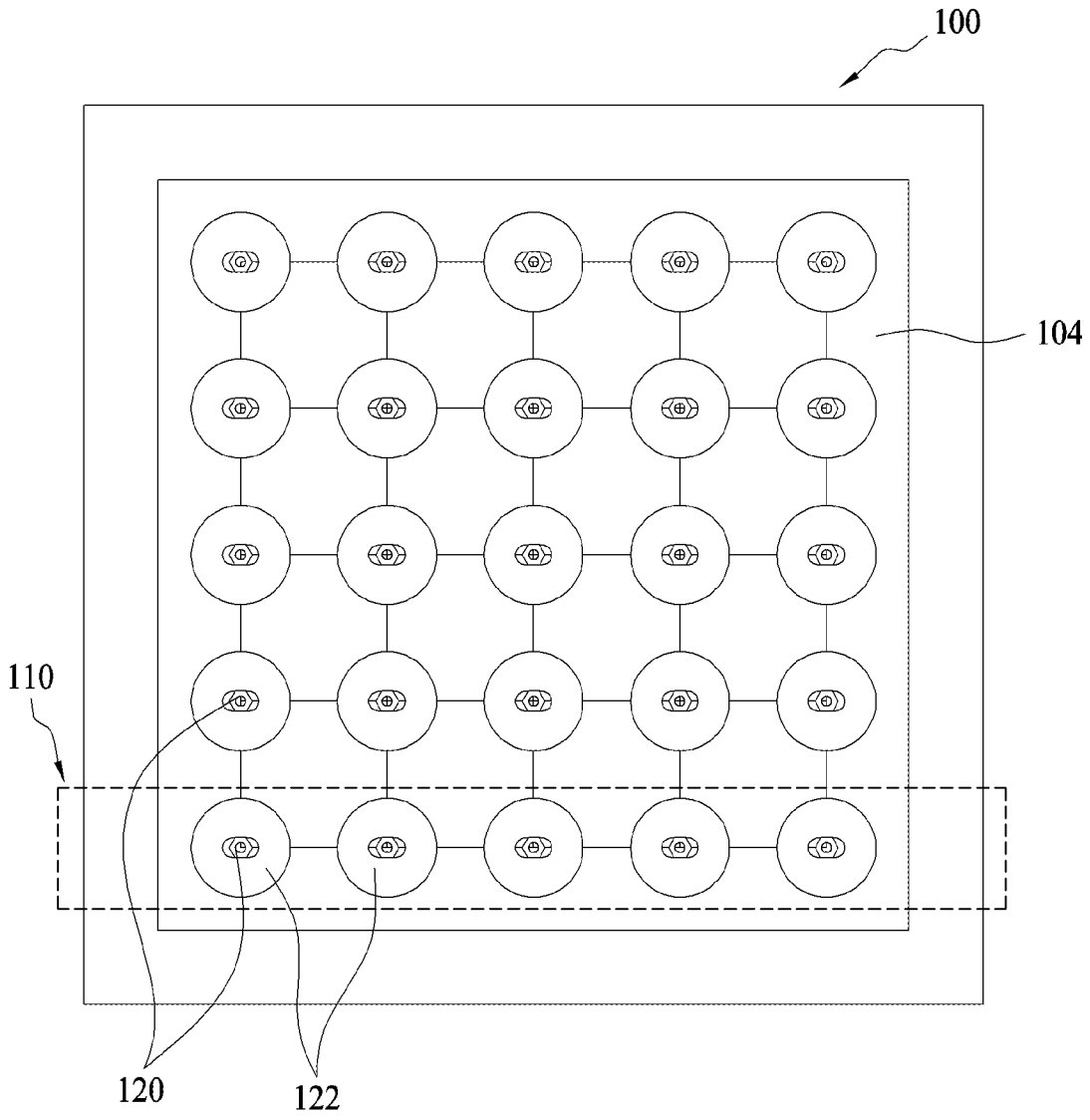
FIG. 2 is a plan view illustrating the atypical-molded-body manufacturing device according to the first embodiment of the present invention.
Figure 3:
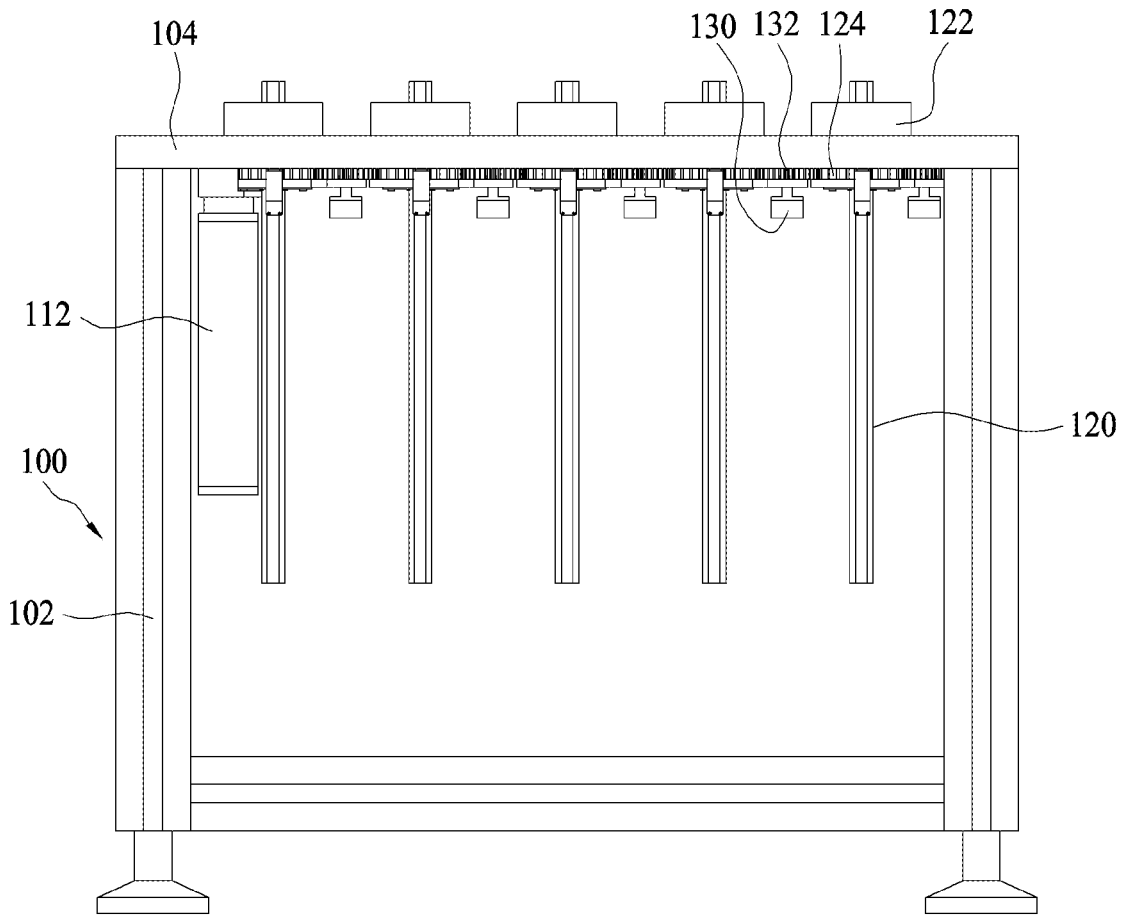
FIG. 3 is a front view illustrating the atypical-molded-body manufacturing device according to the first embodiment of the present invention.
Figure 4:
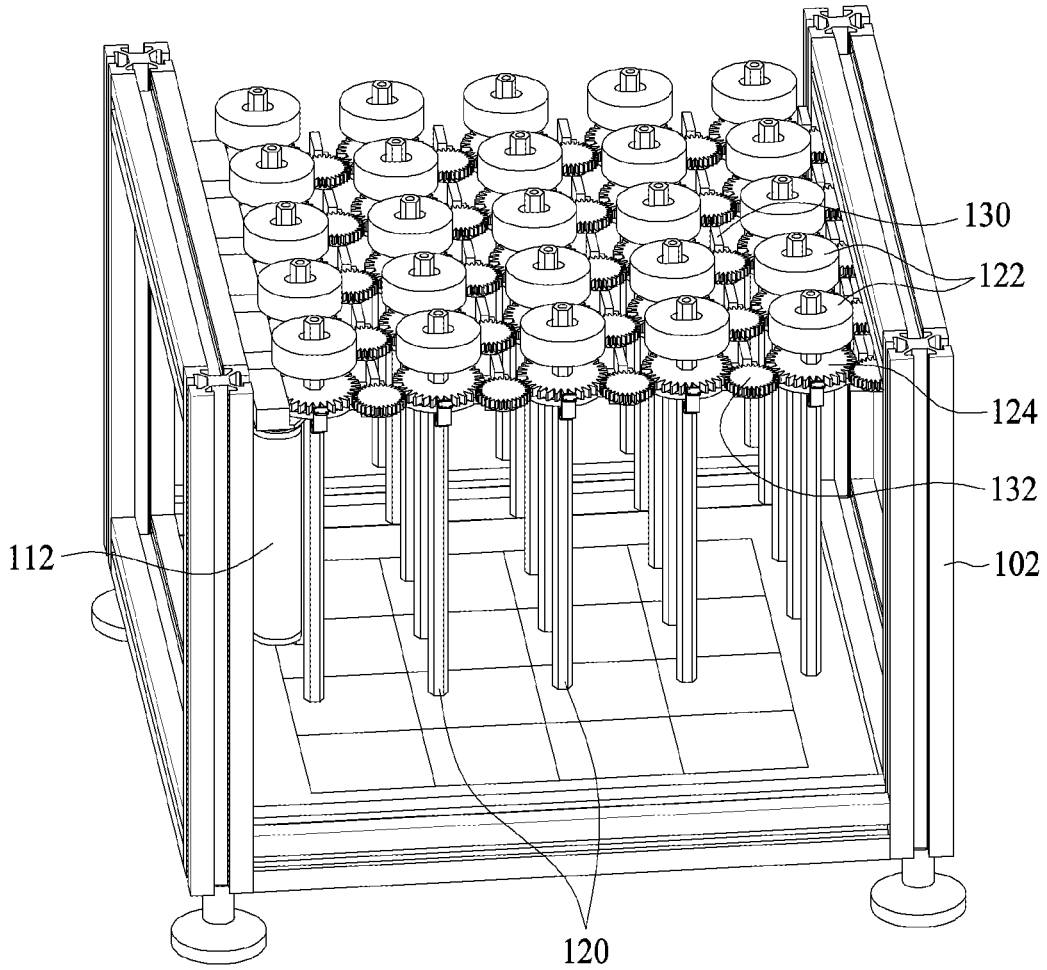
FIG. 4 is a perspective view illustrating an internal structure of the atypical-molded-body manufacturing device according to the first embodiment of the present invention.

FIGS. 1 to 3 are a perspective view, a plan view, and a front view illustrating an atypical-molded-body manufacturing device 100 according to a first embodiment of the present invention. Further, FIG. 4 is a perspective view illustrating an internal structure of the atypical-molded-body manufacturing device 100 according to the first embodiment of the present invention.

As illustrated in FIGS. 1 to 4, the atypical-molded-body manufacturing device 100 according to the first embodiment of the present invention includes at least one shape output units 110 having a movable rod 120 and a driving module. That is, the shape output unit 110 forms a single unit. One or a plurality of shape output unit(s) may be provided.

The movable rod 120 is provided to be movable up and down, and a plurality of movable rods is arranged along a first direction. That is, the movable rods 120 are arranged in a row. When the plurality of shape output units 110 are provided in a second direction that is perpendicular to the first direction, the movable rods 120 may be horizontally and vertically arranged in a grid shape.

The driving module is a component that transfers a driving force to the movable rods 120, thereby moving each of the plurality of movable rods 120 to a predetermined height. According to this embodiment, the driving module includes a main actuator 112, a main gear 124, an auxiliary gear 132, and an auxiliary actuator 130.

The main gear 124 is provided such that the movable rod 120 passes there through. As the main gear rotates forwards or reverse, it may move the movable rod 120 up and down.

To this end, according to this embodiment, threads are spirally formed on a circumferential surface of the movable rod 120, while threads are formed on the main gear 124 to correspond to the threads of the movable rod 120.

Particularly, according to this embodiment, the movable rod 120 further includes a fixing member 122 that fixes the movable rod 120 to prevent it from being rotated. Thus, when the main gear 124 rotates, the movable rod 120 may move up and down.

Further, the main actuator 112 is a component that transfers the driving force to rotate the main gear 124. In this embodiment, one main actuator corresponds to each shape output unit 110, and is provided on a side of an associated shape output unit 110.

The auxiliary gear 132 may be provided between a pair of neighboring main gears 124, and may be moved by the auxiliary actuator 130. That is, the auxiliary actuator 130 may move the auxiliary gear 132 so that the auxiliary gear 132 optionally engages with the main gear 124. Thus, the driving force may be optionally transferred from the main actuator 112 to the movable rod 120. A process of driving the driving module and the movable rod 120 will be described below in detail.

In the present invention, at least one shape output unit having a plurality of movable rods 120 and the driving module is provided. Thus, it is possible to form the atypical curvature by a difference in level between upper ends of the plurality of movable rods 120 that have moved to predetermined heights, respectively.

Meanwhile, this embodiment includes a fixing frame 104 having through holes through which the plurality of movable rods 120 pass to guide the movable rods 120, and a support frame 102 that supports the fixing frame 104.

According to this embodiment, the fixing frame 104 is formed in the shape of a flat plate that is wider than a total area occupied by the shape output unit 110. Particularly, the driving module is located under the fixing frame 104 to prevent it from being damaged or prevent a worker from being injured. Further, the fixing member 122 is seated on the fixing frame 104.

Further, the support frame 102 is formed to be longer than the movable rod 120, so that the movable rod 120 does not come into contact with a bottom surface when the movable rod 120 moves to a lowermost point.

Figure 5:
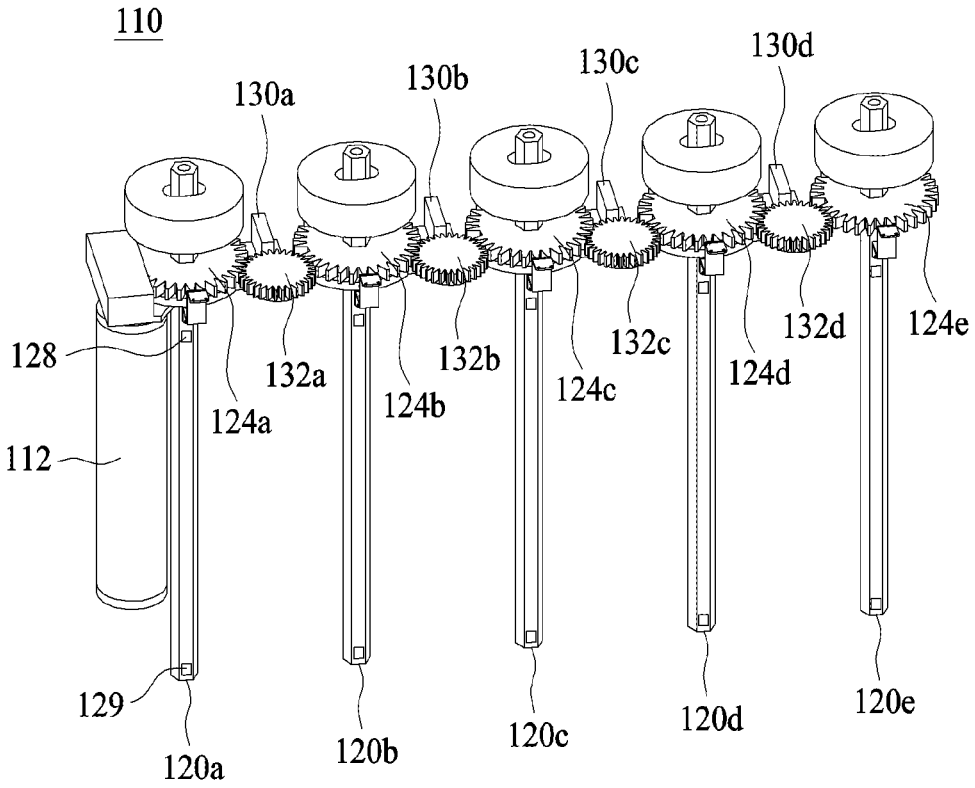
FIG. 5 is a detailed perspective view illustrating a shape output unit of the atypical-molded-body manufacturing device according to the first embodiment of the present invention.

FIG. 5 is a detailed perspective view illustrating the shape output unit 110 of the atypical-molded-body manufacturing device according to the first embodiment of the present invention.

As described above, the shape output unit 110 includes the movable rods 120 and the driving module. The driving module includes the main actuator 112, the main gear 124, the auxiliary actuator 130, and the auxiliary gear 132.

According to this embodiment, the movable rod 120 includes a first sensor 128 that is provided on an upper portion of the movable rod 120 to detect the height of the movable rod 120 and limit the lowest height of the movable rod 120, and a second sensor 129 that is provided on a lower portion of the movable rod 120 to limit the highest height of the movable rod 120.

That is, the first sensor 128 detects that the movable rod 120 moves down to a preset lowest height, and then transmits associated data to a controller. The second sensor 129 detects that the movable rod 120 moves up to a preset highest height, and then transmits associated data to the controller. Thus, the controller may stop driving the main actuator 112.

Meanwhile, according to this embodiment, five movable rods 120, five main gears 124, five auxiliary actuators 130, and five auxiliary gears 132 are provided, respectively. For the convenience of description, these components will be sequentially numbered from the left to the right of the drawing. Based on the fact, the process of driving the shape output unit 110 will be described below.

FIGS. 6 to 14 are perspective views illustrating the process of driving the shape output unit 110 of the atypical-molded-body manufacturing device according to the first embodiment of the present invention.

Figure 6:
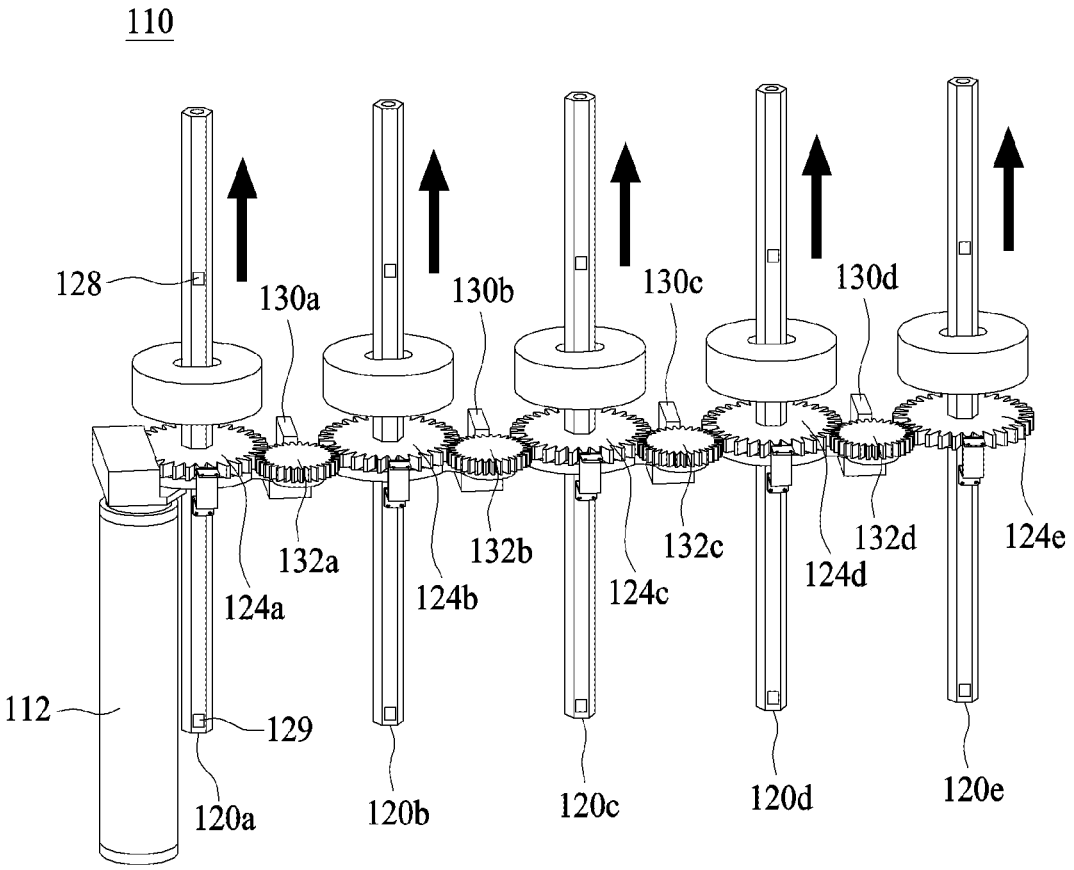
FIGS. 6 to 14 are perspective views illustrating a process of driving the shape output unit of the atypical-molded-body manufacturing device according to the first embodiment of the present invention.

First, as illustrated in FIG. 6, first to fourth auxiliary gears 132*a* to 132*d* engage with a pair of neighboring main gears. Thus, the driving force of the main actuator 112 may be transmitted sequentially from a first main gear 124*a* to a fifth main gear 124*e*. In such a state, the main actuator 112 is rotated in one direction. Thereby, all the movable rods 120*a* to 120*b* move up to a uniform height.

This is to set the height of a fifth movable rod 120*e* that is the farthest away from the main actuator 112. That is, since one main actuator 112 controls a plurality of movable rods 120*a* to 120*e*, the movable rods 120*a* to 120*e* are sequentially controlled from the farthest rod.

Figure 7:
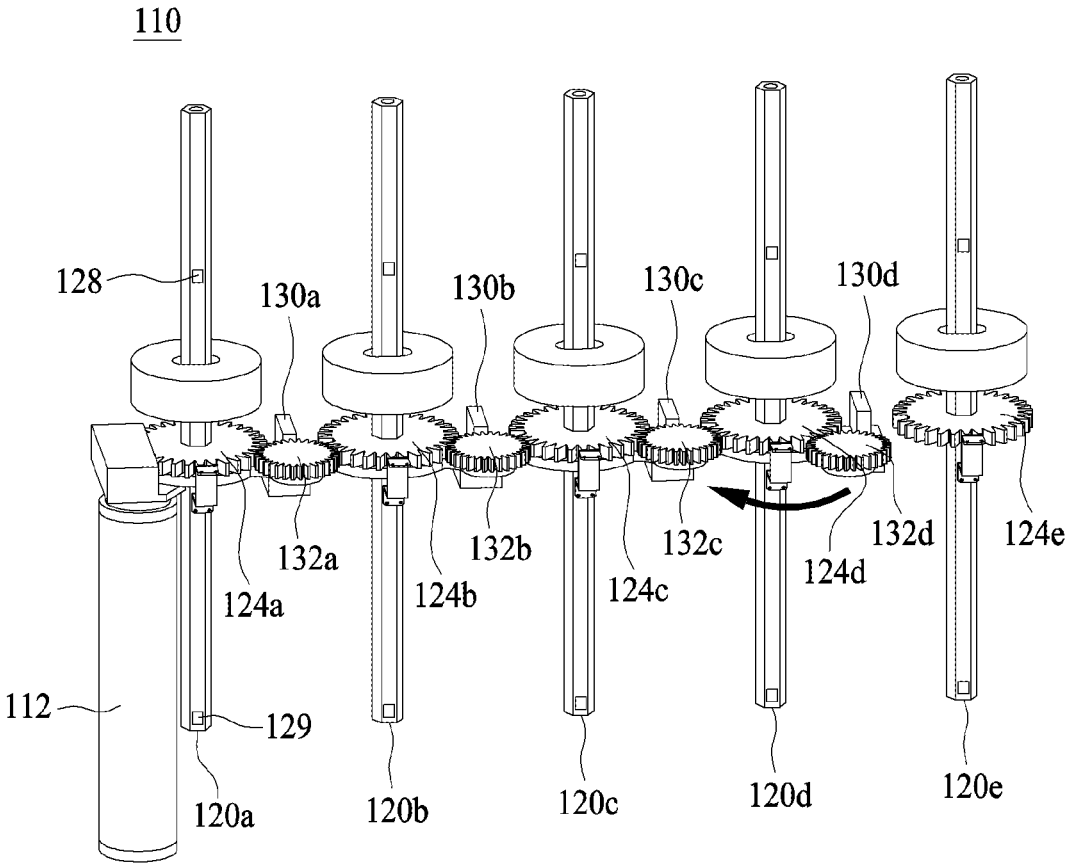

Subsequently, as illustrated in FIG. 7, a fourth auxiliary actuator 130*d* is controlled to move the fourth auxiliary gear 132*d* engaging with the fifth main gear 124*e*. Thus, the driving force transmitted to the fifth movable rod 120*e* is blocked, and the fifth movable rod 120*e* is not affected even if the main actuator 112 is rotated.

Figure 8:
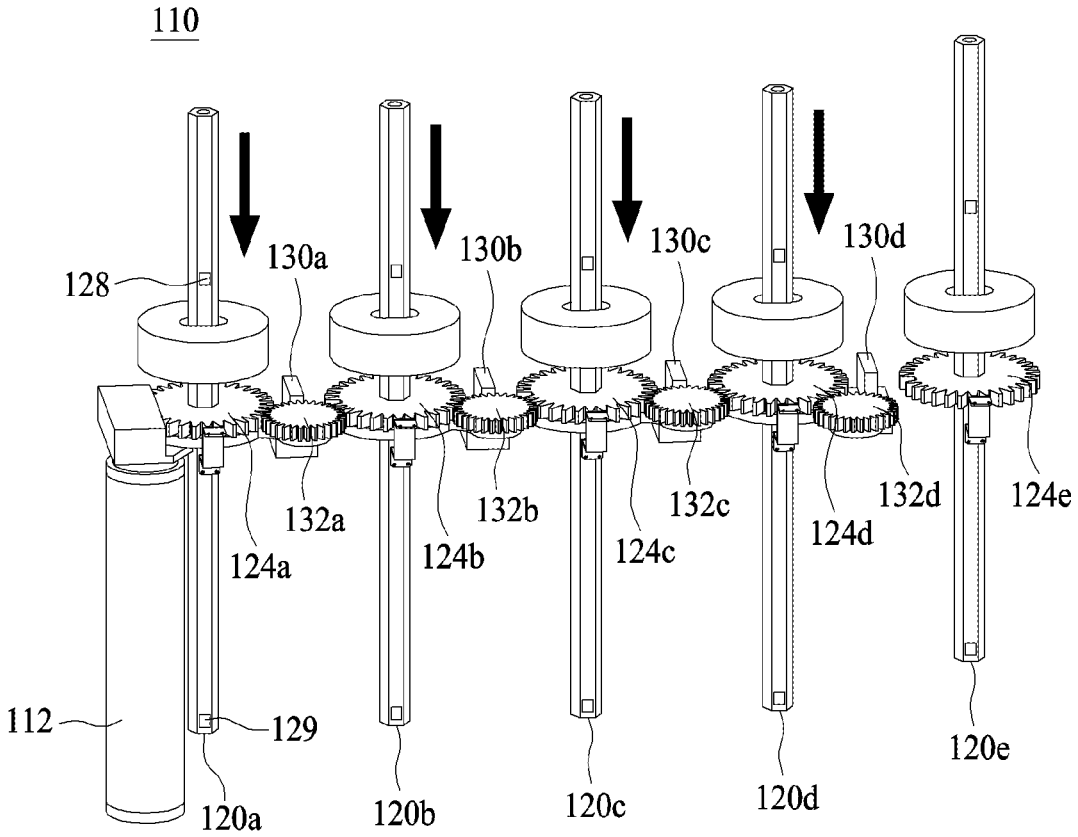

As illustrated in FIG. 8, the main actuator 112 is rotated in the other direction, thus downwardly moving the remaining movable rods 120*a* to 120*d* except for the fifth movable rod 120*e*. This locates the fourth movable rod 120*d* to a desired height.

Figure 9:
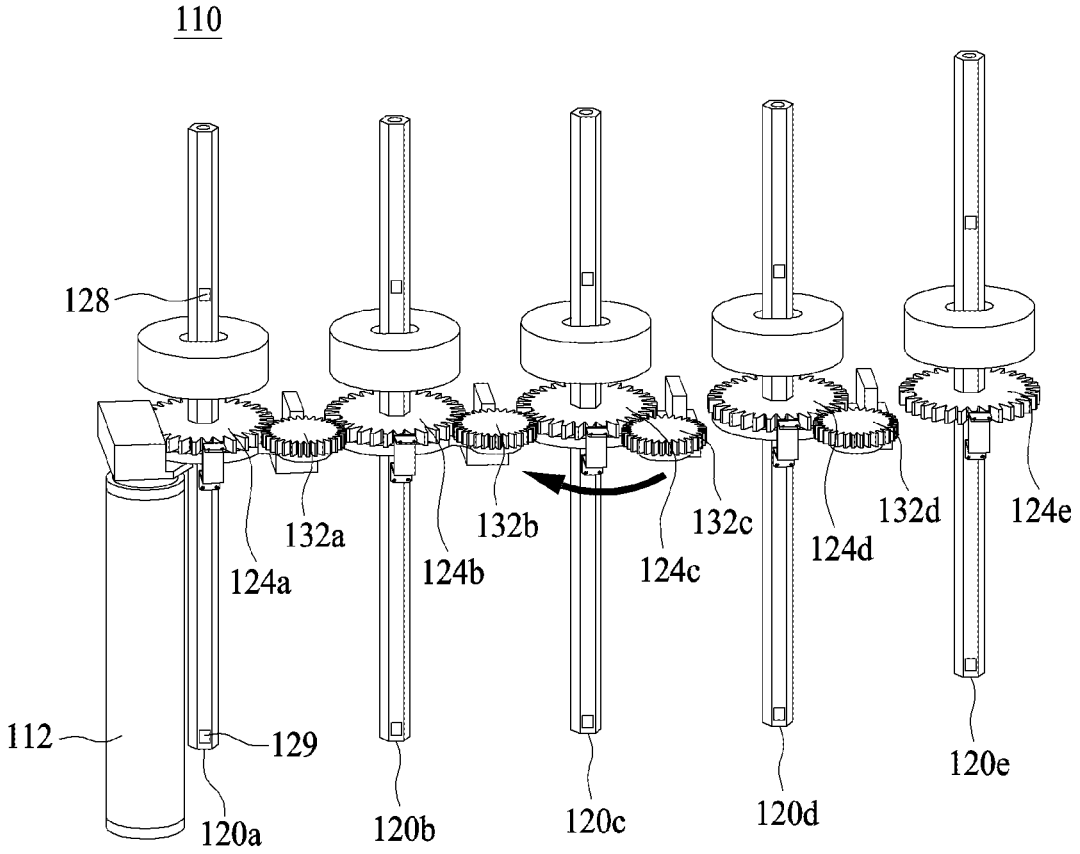

Next, as illustrated in FIG. 9, the third auxiliary actuator 130*c* is controlled to move the third auxiliary gear 132*c* engaging with the fourth main gear 124*d*. Thus, the driving force transmitted to the fourth movable rod 120*d* is blocked, and the fourth movable rod 120*d* is not affected even if the main actuator 112 is rotated.

Figure 10:
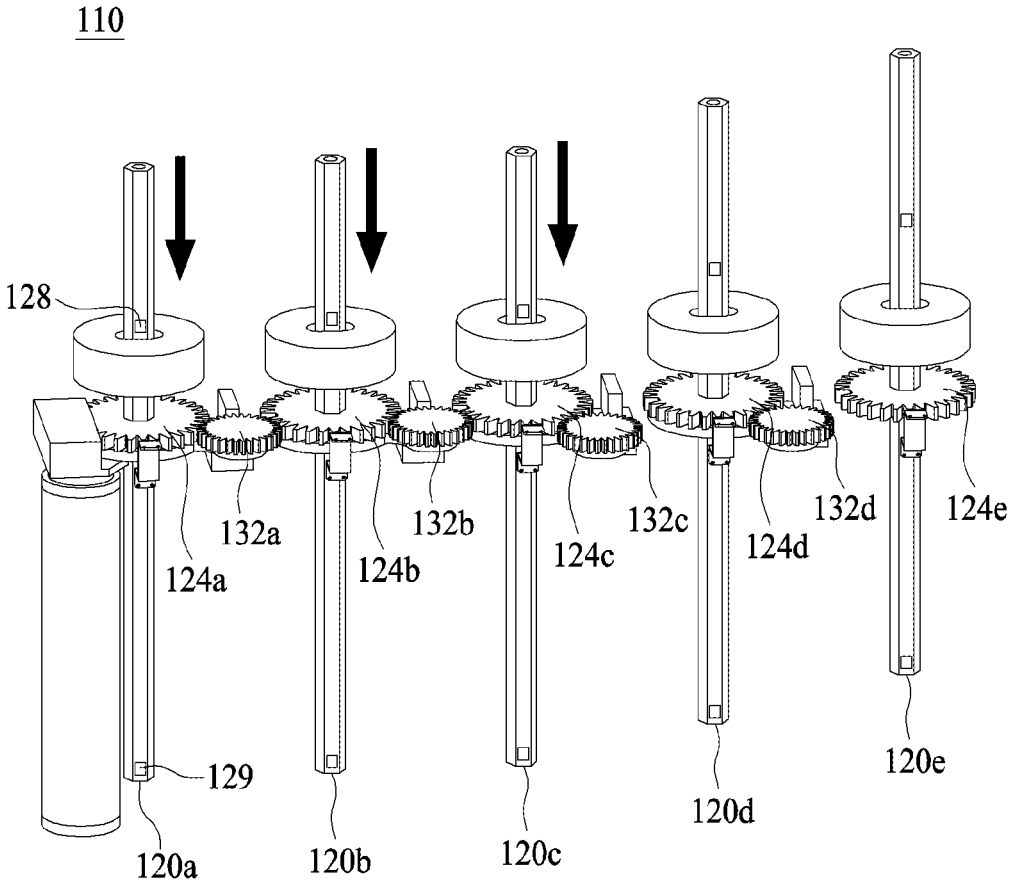
Figure 11:
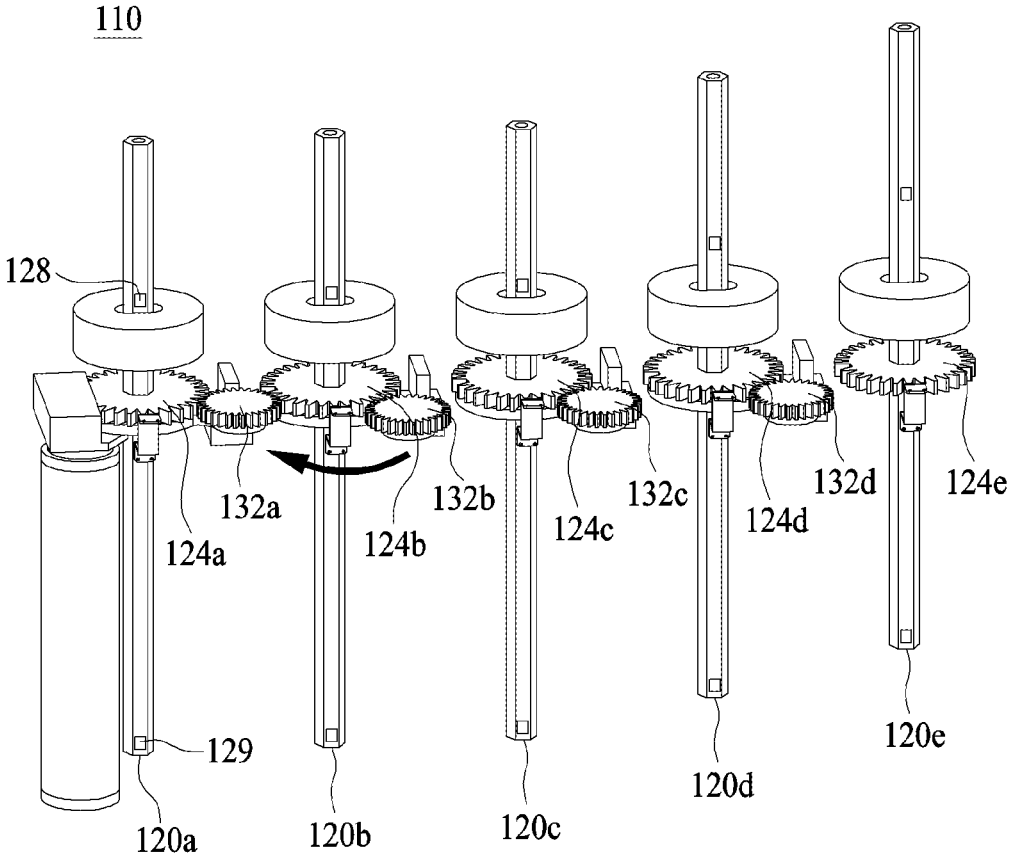
Figure 12:
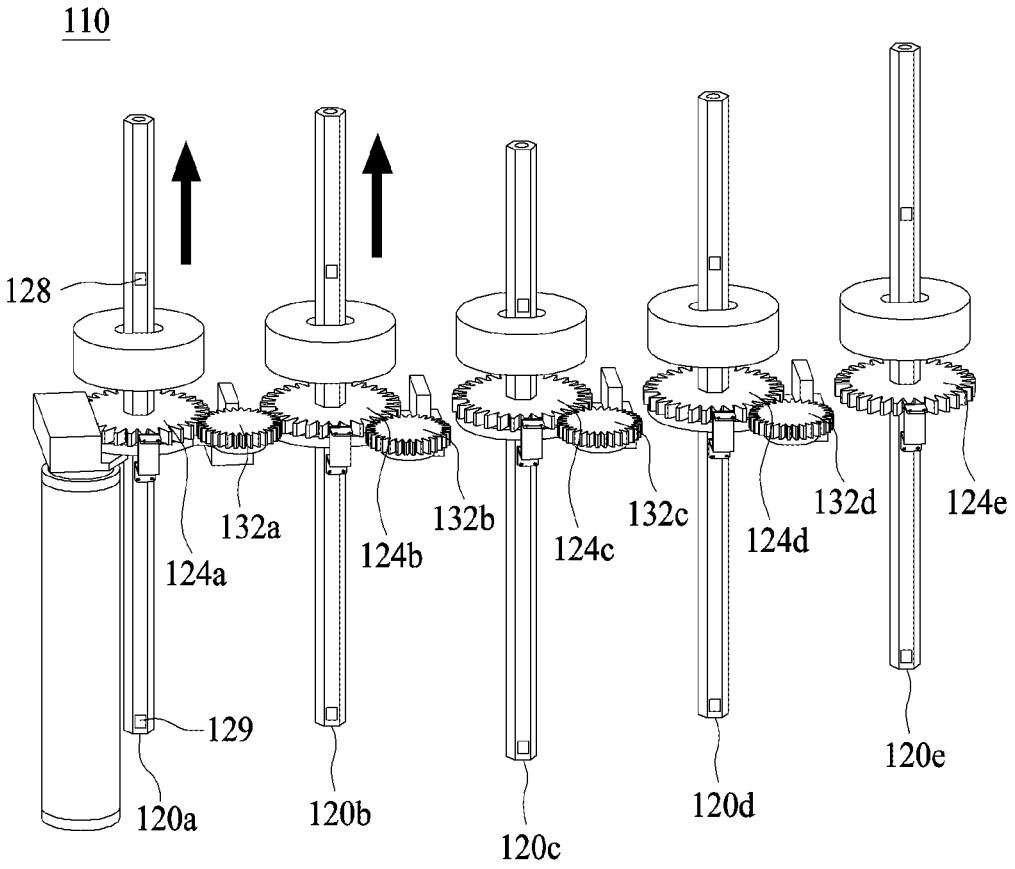
Figure 13:
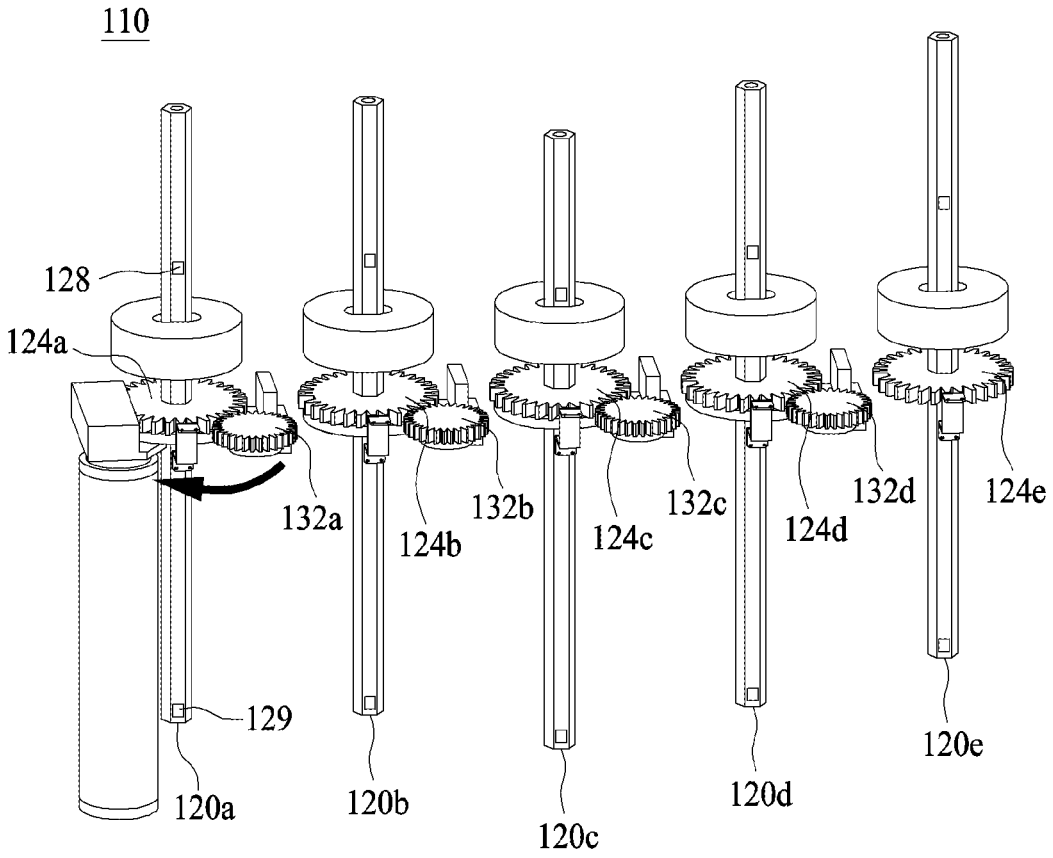
Figure 14:
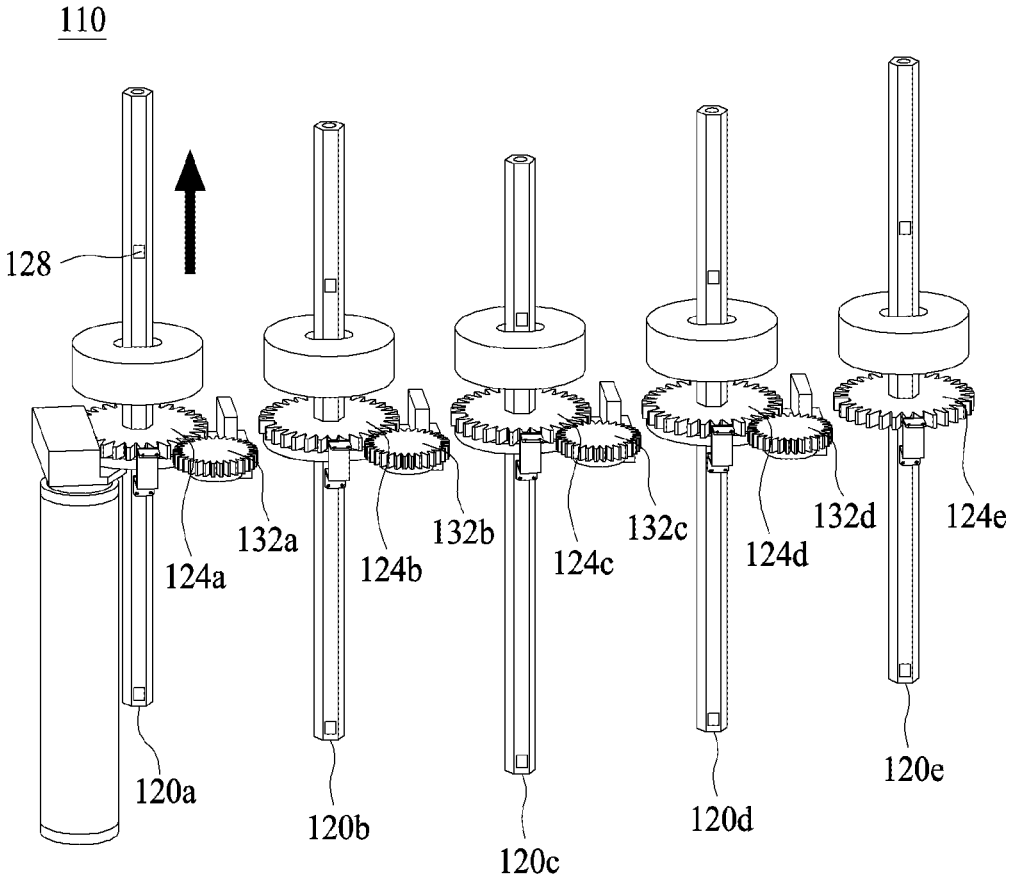

Further, as illustrated in FIG. 10, the main actuator 112 is rotated in the other direction, thus downwardly moving the first movable rod 120*a*, the second movable rod 120*b*, and the third movable rod 120*c*. Thus, the third movable rod 120*c* is located to a desired height.

Subsequently, as illustrated in FIGS. 11 to 14, the above-described process is repeated, so that the first movable rod 120*a* and the second movable rod 120*b* are located to desired positions. That is, after the second auxiliary actuator 130*b* moves the second auxiliary gear 132*b* to block power transmission, the second movable rod 120*b* is moved. Thereafter, after the first auxiliary actuator 130*a* moves the first auxiliary gear 132*a* to block power transmission, the first movable rod 120*a* is moved.

The above-described process allows the shape output unit 110 to form the atypical curvature by a difference in level between the upper ends of the movable rods 120*a* to 120*e*.

According to this embodiment, since a plurality of shape output units 110 are provided along the first direction, the height of the movable rods that are horizontally and vertically arranged in the grid shape is controlled, thus expressing the shape of various curved surfaces.

The moving height of the movable rods 120*a* to 120*e* illustrated in FIGS. 6 to 15 is proposed by way of an example. This may be implemented to have a height different from that of this embodiment.

Although not shown in the drawings, this embodiment may further include an encoder that calculates the height data of the movable rods 120*a* to 120*e*. The encoder is operated in conjunction with the first sensor 128 and the second sensor 129 that measure the height of the movable rods 120*a* to 120*e*, thus calculating the height of the movable rods 120*a* to 120*e*. Alternatively, the height of the movable rods 120*a* to 120*e* may be calculated by measuring the revolution number of the main gears 124*a* to 124*e*.

The height data of every moment stored by the encoder as such may be utilized as analysis data, and may be reflected to control the movable rods 120*a* to 120*e*.

Figure 15:
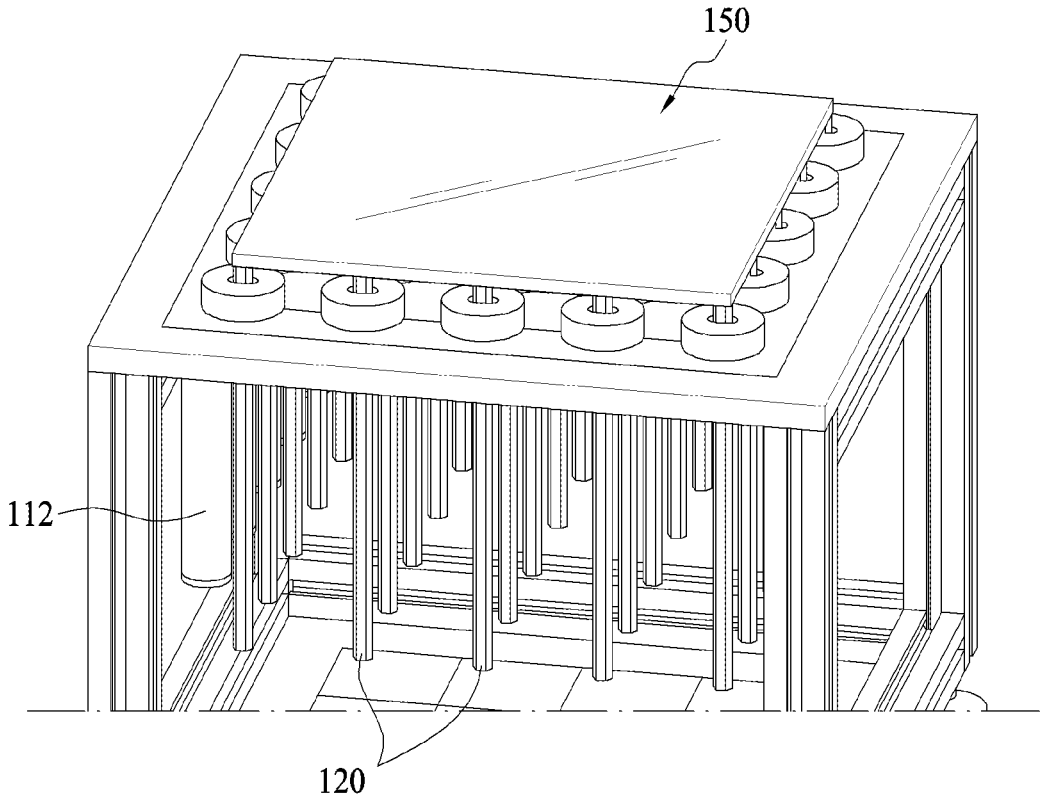
FIG. 15 is a perspective view illustrating a state in which a deformation pad is provided on the shape output unit of the atypical-molded-body manufacturing device according to the first embodiment of the present invention.
Figure 16:
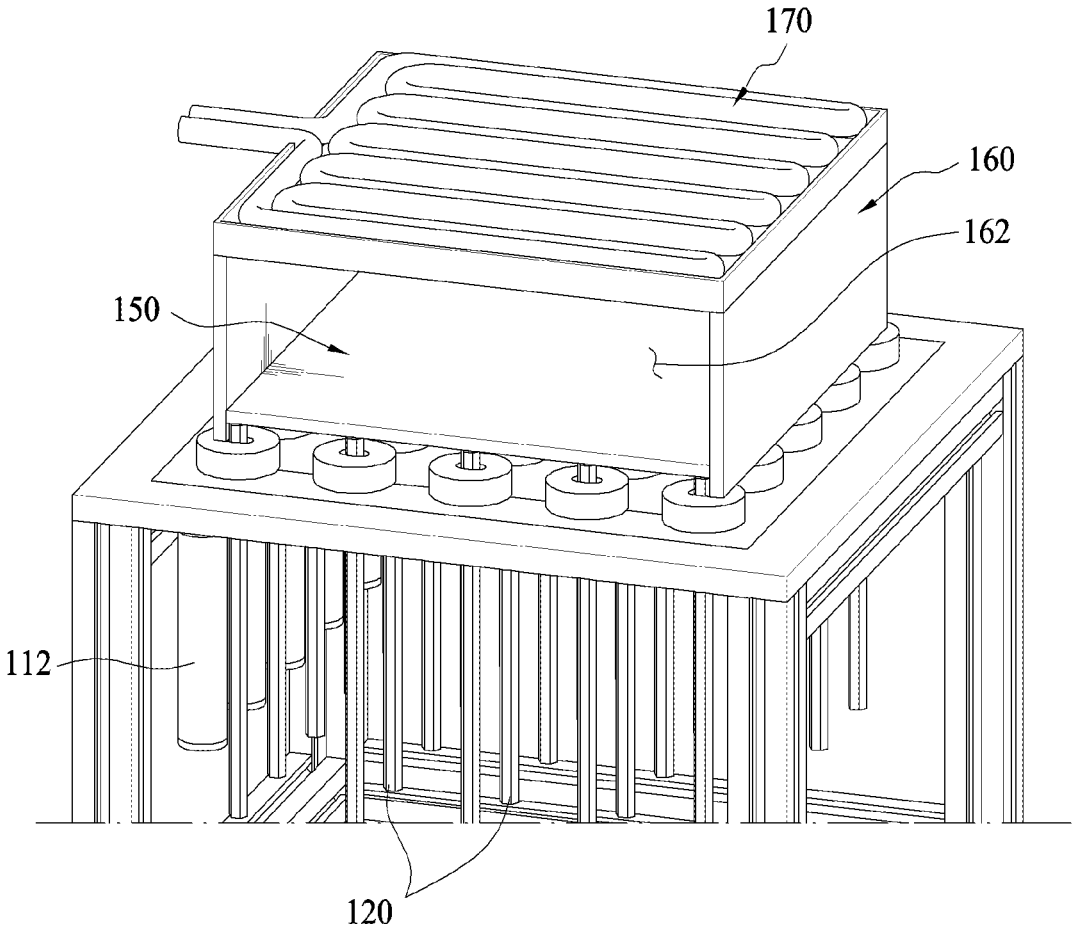
FIG. 16 is a perspective view illustrating a state in which a molding unit and a curing unit are provided on the deformation pad of the atypical-molded-body manufacturing device according to the first embodiment of the present invention.

FIG. 15 is a perspective view illustrating a state in which a deformation pad 150 is provided on the shape output unit of the atypical-molded-body manufacturing device according to the first embodiment of the present invention, FIG. 16 is a perspective view illustrating a state in which a molding material casting form for manufacturing an atypical molded body including a molding unit 160 and a curing unit 170 is provided on the deformation pad 150 of the atypical-molded-body manufacturing device according to the first embodiment of the present invention. Further, FIG. 17 is a front view illustrating a state in which the deformation pad 150 of the atypical-molded-body manufacturing device according to the first embodiment of the present invention is deformed as the movable rod 120 moves up and down.

Figure 17:
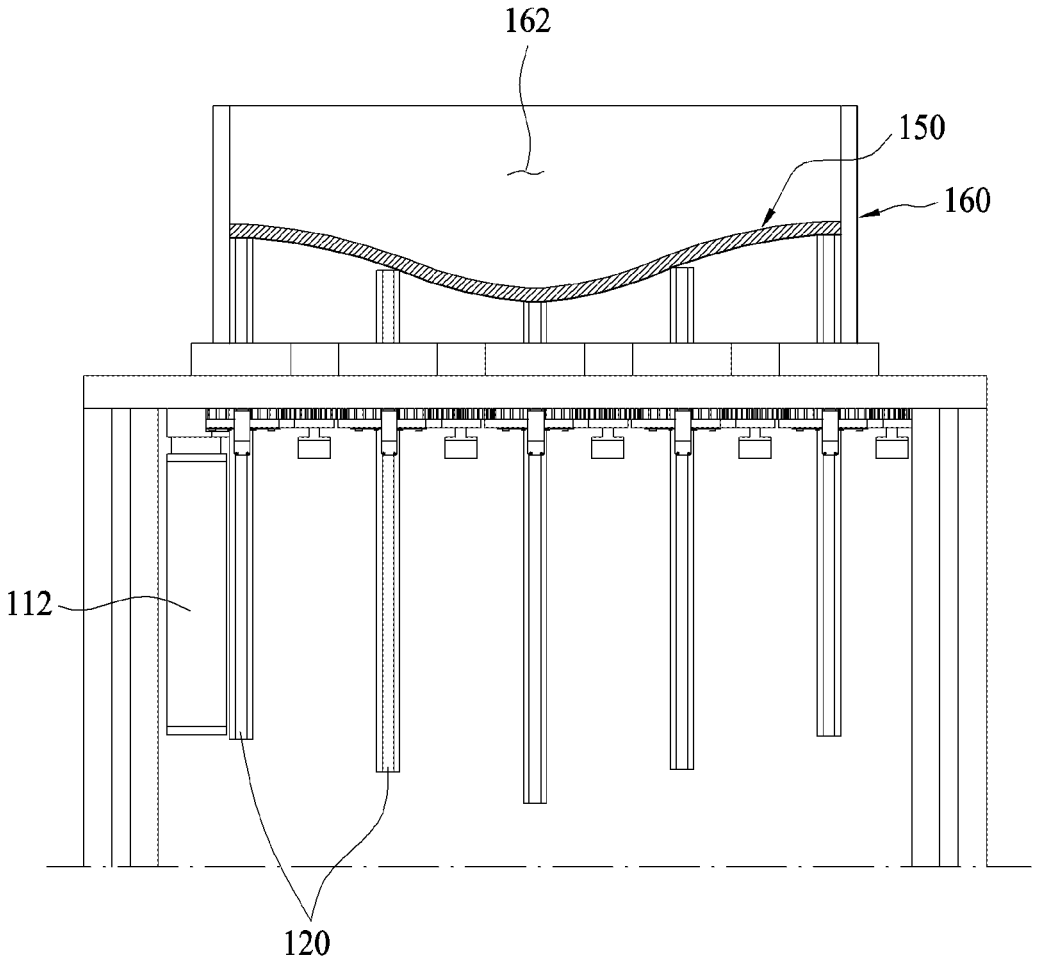
FIG. 17 is a front view illustrating a state in which the deformation pad of the atypical-molded-body manufacturing device according to the first embodiment of the present invention is deformed as a movable rod moves up and down.

As illustrated in FIGS. 15 to 17, this embodiment may provide the molding material casting form for manufacturing the atypical molded body, including the deformation pad 150, the molding unit 160, and the curing unit 170.

The deformation pad 150 is a component that is seated on the shape output unit, is formed to have flexibility, and is deformed as the movable rod 120 moves up and down, thus defining curvature.

The deformation pad 150 may be formed of various materials such as rubber, and may be selected based on the estimation of various items, such as a normal operating temperature, repulsive elasticity, proof bending cracking, proof compressive permanent reduction rates, abrasion resistance or elastic-expansion coefficients. For example, CR (chloroprene), CM, NBR (nitrile butadiene rubber), NR (natural rubber), SBR, BR (butadiene rubber) or the like may be used, but the invention is not limited thereto.

The molding unit 160 is a component that defines a molding space 162 above the shape output unit. The molding unit is shielded at a side thereof at least and has the deformation pad 150 as a bottom thereof. Various fluids for forming the molded body may be injected into the molding space 162.

That is, the molding unit 160 serves as a casting form for forming the molded body. Since the deformation pad 150 constitutes the bottom, a surface corresponding to the deformation pad 150 has an atypical curvature when the molded body is formed.

In this regard, a phase change material (PCM) may be used as the fluid for forming the molded body. The molded body formed in this way may be subsequently used as a mold for manufacturing the atypical molded body. However, without being limited thereto, it is possible to form the atypical molded body directly from concrete or the like using the molding unit 160.

The curing unit 170 is a component that heats to cure the molding material injected into the molding space 162. According to this embodiment, the curing unit is provided to shield a top of the molding unit 160.

Meanwhile, in the case of injecting the molding material into the molding space 162, the molding material may possibly leak through a peripheral part of the deformation pad 150 that defines the bottom of the molding space 162. In order to prevent the leakage, the peripheral part of the deformation pad 150 may be made in various shapes according to the present invention.

Figure 18:
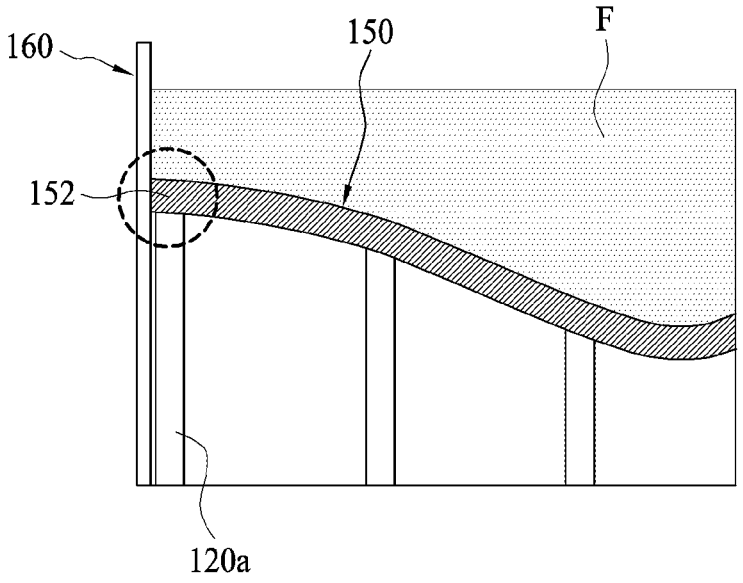
FIGS. 18 to 20 are sectional views illustrating a state in which various peripheral parts of the deformation pad of the atypical-molded-body manufacturing device according to the first embodiment of the present invention are made.
Figure 19:
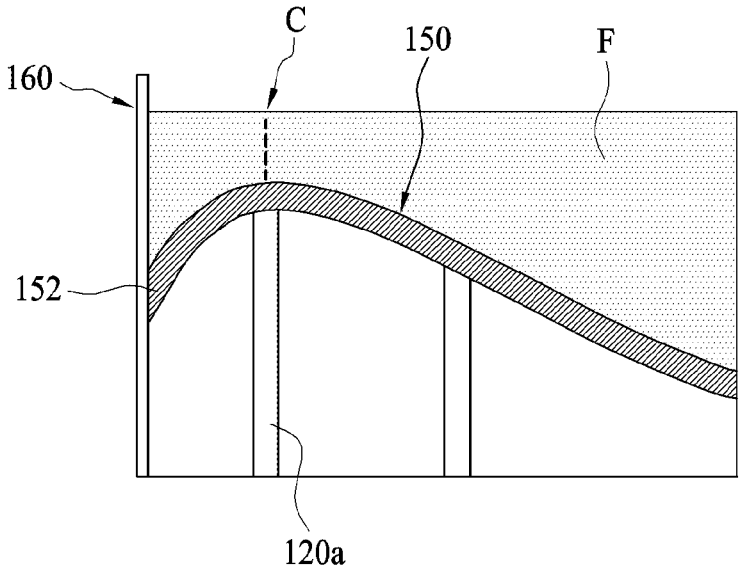
Figure 20:
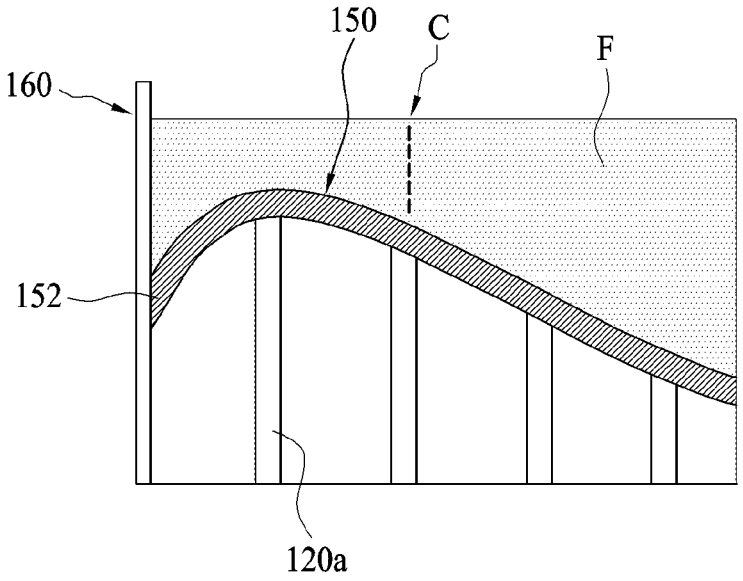

FIGS. 18 to 20 are sectional views illustrating a state in which various peripheral parts 152 of the deformation pad 150 of the atypical-molded-body manufacturing device according to the first embodiment of the present invention are made.

First, as illustrated in FIG. 18, the first movable rod 120*a* provided on the outermost position of the shape output unit may be arranged to be adjacent to a sidewall of the molding unit 160. In this case, the first movable rod 120*a* stably supports the peripheral part 152 of the deformation pad 150 and causes the peripheral part 152 of the deformation pad 150 to be in close contact with a sidewall of the molding unit 160, thus preventing the molding material F from leaking out.

In this regard, the first movable rod 120*a* is only one example of the movable rods that are located at the outermost position.

Further, as illustrated in FIGS. 19 and 20, the peripheral part 152 of the deformation pad 150 may be attached to the sidewall of the molding unit 160. In this case, the leakage of the molding material F may be prevented or there is a possibility that distortion occurs at an outer side of the first movable rod 120*a*.

Therefore, after the molding material F is cured, the surrounding area of the molded body may be cut toward the way of removing the area which distortion may be occurred in. However, as illustrated in FIG. 19, if the cutting operation is performed using a position corresponding to the first movable rod 120*a* as a cutting reference line C, a distorted shape may be left due to a rapid change in curvature. Hence, as illustrated in FIG. 20, the cutting operation may be performed by setting the cutting reference line C to be situated inside the first movable rod 120*a*.

Figure 21:
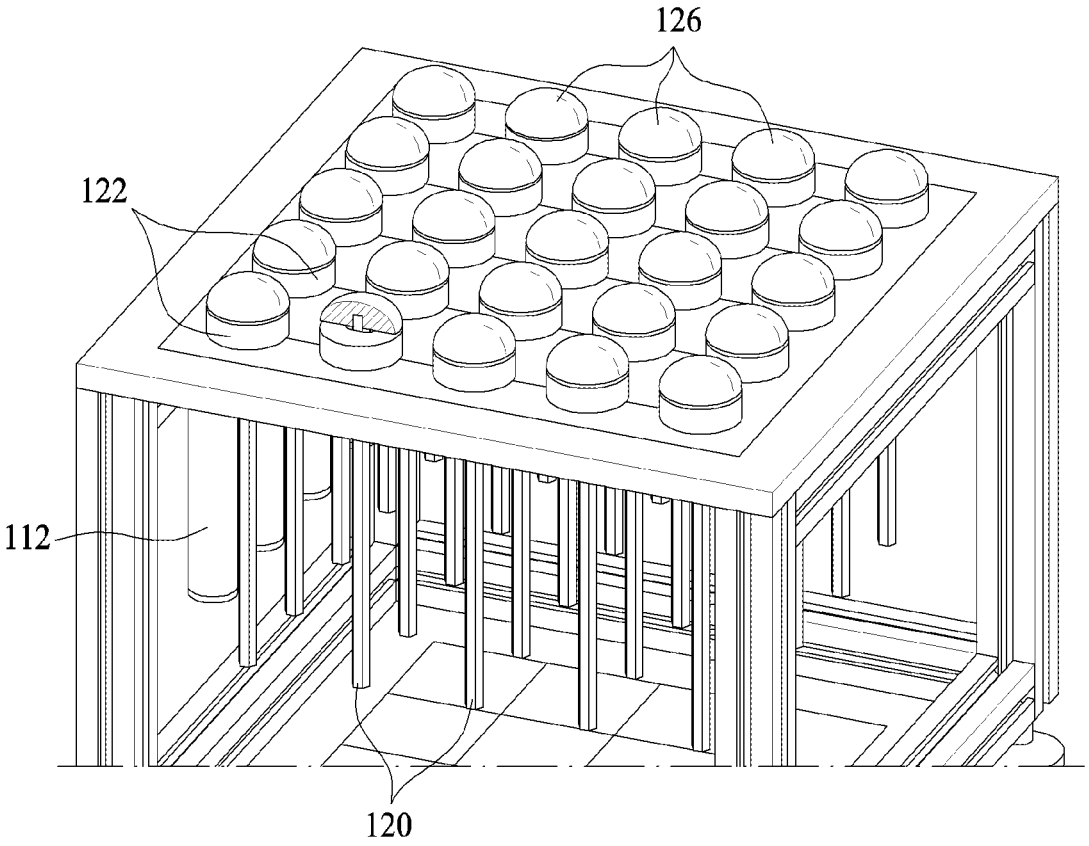
FIG. 21 is a perspective view illustrating a state in which a cap member is provided on an upper end of the movable rod of the atypical-molded-body manufacturing device according to the first embodiment of the present invention.

FIG. 21 is a perspective view illustrating a state in which a cap member 126 is provided on the upper end of the movable rod 120 of the atypical-molded-body manufacturing device according to the first embodiment of the present invention.

As illustrated in FIG. 21, this embodiment may further include the cap member 126. The cap member 126 is a component that is provided on the upper end of the movable rod 120 and increases a contact surface with the above-described deformation pad.

Thus, the cap member 126 may prevent the shape of the movable rod 120 from being projected on the deformation pad, or prevent a bending angle of the deformation pad from being rapidly changed in a portion where the movable rod 120 is located.

Although the first embodiment of the present invention has been described, a second embodiment in which a structure of the driving module is modified will be described below.

Figure 22:
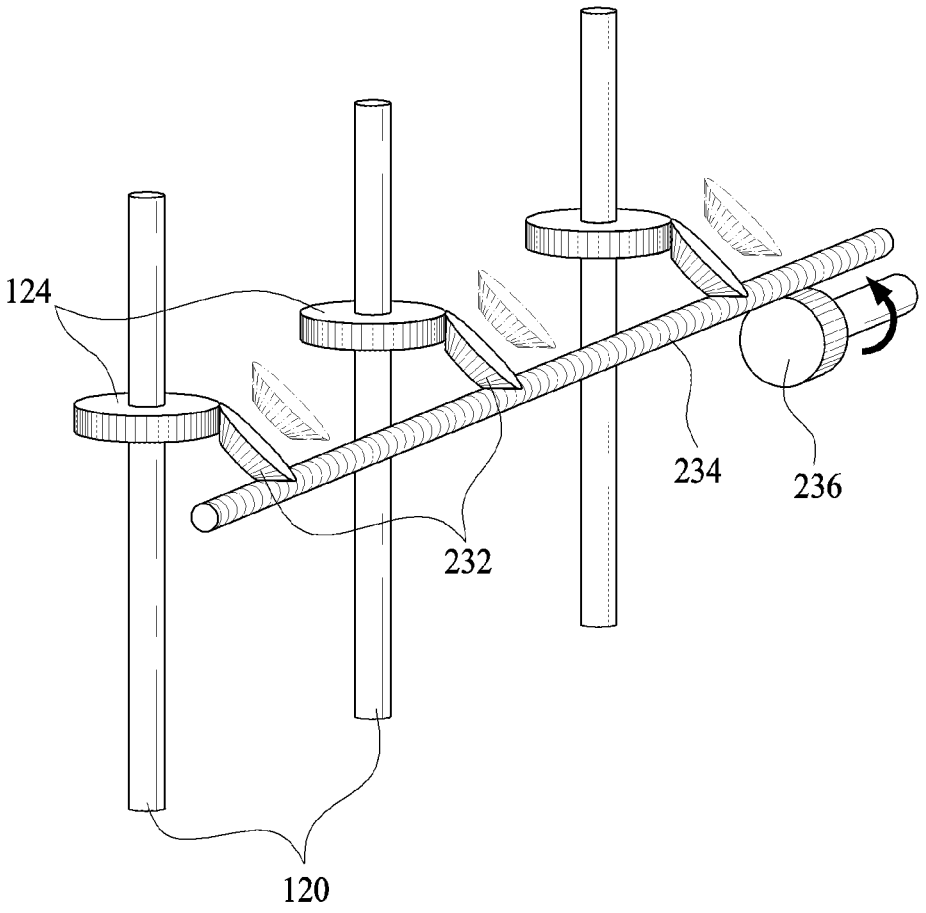
FIG. 22 is a perspective view illustrating a shape output unit of an atypical-molded-body manufacturing device according to a second embodiment of the present invention.

FIG. 22 is a perspective view illustrating a shape output unit of an atypical-molded-body manufacturing device according to the second embodiment of the present invention. In the second embodiment of the present invention illustrated in FIG. 22, the driving module is slightly different from that of the above-described first embodiment.

This embodiment is the same as the first embodiment in that the driving module includes main gears 124, auxiliary gears 232, and auxiliary actuators (not shown). However, the auxiliary gear does not engage with a pair of neighboring main gears 124, but engages with only any one of the main gears 124 in one-to-one correspondence.

This embodiment further includes a gear bar 234 engaging with the auxiliary gear 232 that simultaneously engages with the main gear 124. The gear bar 234 is rotated by the main actuator to transmit a driving force to the associated main gear 124.

That is, this embodiment is advantageous in that the driving force of the main actuator is not sequentially transmitted from one main gear 124 to another main gear, so that it is possible to individually drive each movable rod 120. Therefore, the driving speed may be remarkably improved as compared to the first embodiment.

Meanwhile, according to this embodiment, the gear bar 234 is rotated by a connecting gear 236 that is connected to the main actuator. However, the gear bar 234 may be directly connected to the main actuator.

Figure 23:
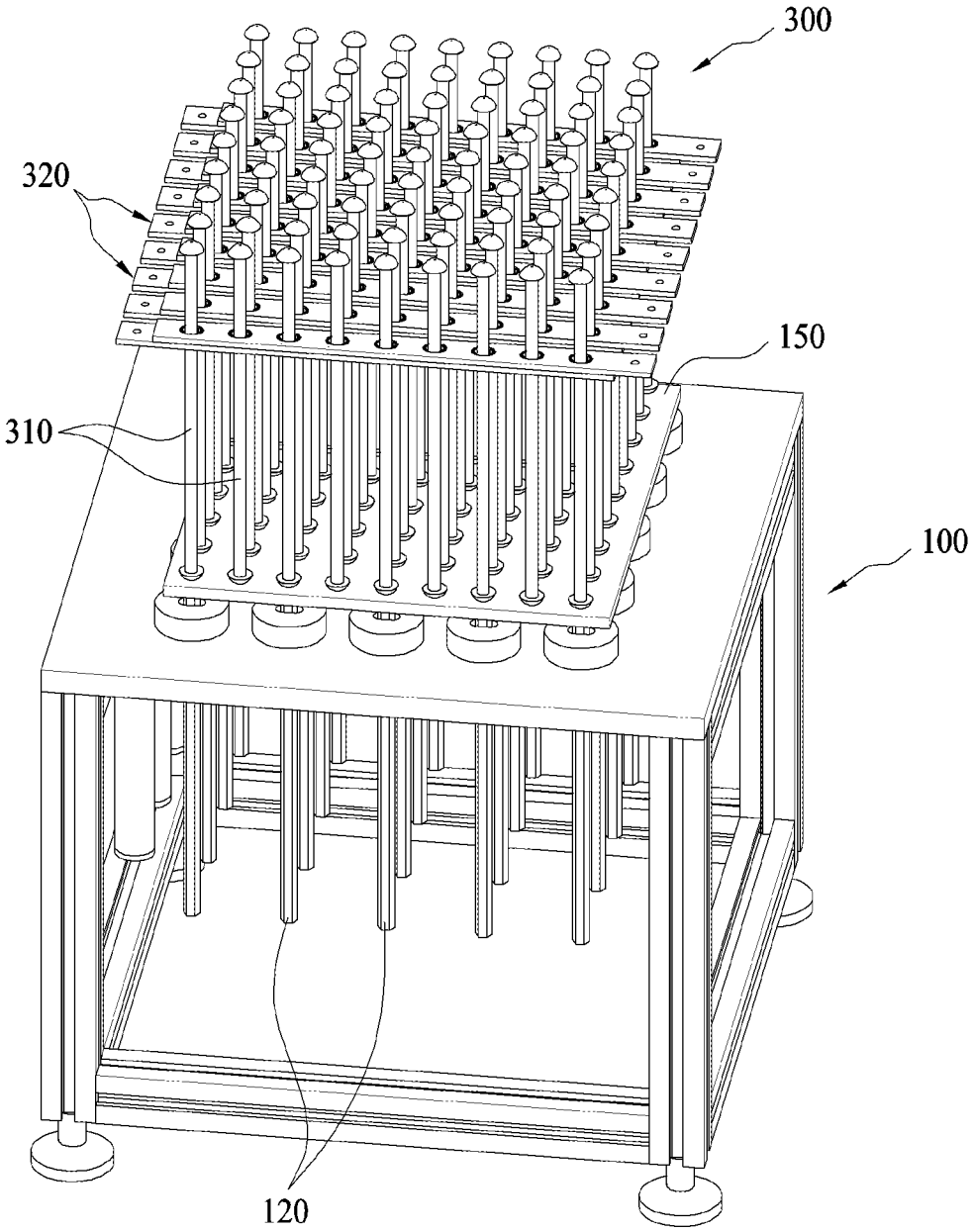
FIG. 23 is a perspective view illustrating a state in which a rod-type mold is seated on a shape output unit of an atypical-molded-body manufacturing device according to a third embodiment of the present invention.

FIG. 23 is a perspective view illustrating a state in which a rod-type mold 300 is seated on a shape output unit of an atypical-molded-body manufacturing device according to a third embodiment of the present invention.

As illustrated in FIG. 23, the third embodiment of the present invention further includes a rod-type mold 300. The rod-type mold 300 includes a plurality of auxiliary rods 310 that are moved by the displacement of the movable rods 120 in response to the movable rods 120, and an anchoring part 320 that optionally anchors the auxiliary rods 310 to prevent them from being moved.

That is, in the state where the deformation pad 150 is provided on the plurality of movable rods 120, the rod-type mold 300 is seated on the deformation pad 150, and the auxiliary rods 310 are moved to respond to the deformation of the deformation pad 150 as the movable rods 120 are moved.

Therefore, the displacement of the auxiliary rods 310 corresponds to that of the movable rods 120, and the curvature formed by the auxiliary rods 310 may be the same as the curvature formed by the movable rods 120. That is, the rod-type mold 300 may be used as a base for forming the atypical molded body.

That is, it is possible to manufacture a member such as an atypical concrete panel and a mold for producing an atypical member, using the rod-type mold 300.

Meanwhile, the anchoring part 320 serves to anchor the auxiliary rods 310, thus preventing the displacement of the auxiliary rods 310 from being changed. This may be implemented in various shapes.

Figure 24:
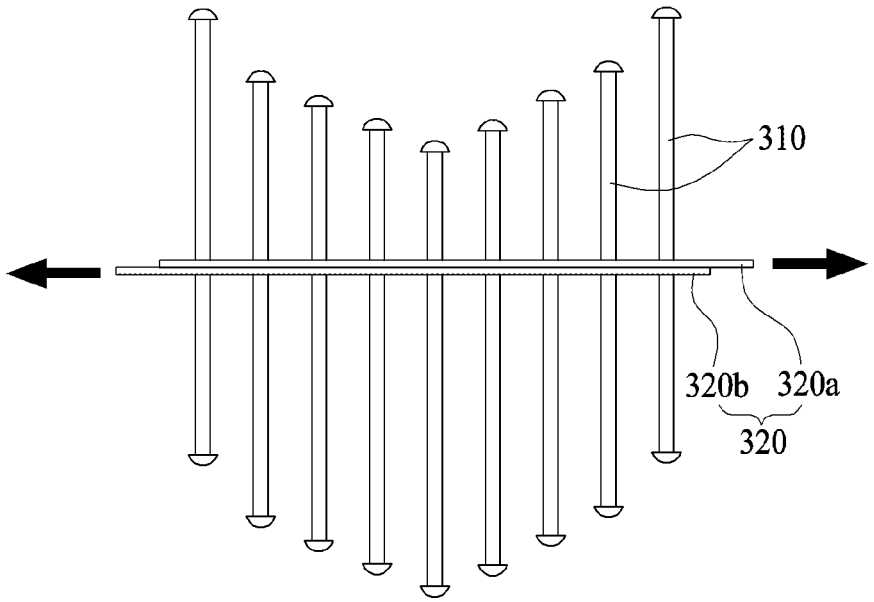
FIGS. 24 to 26 are front and perspective views illustrating fixing parts of the shape output unit implemented in various shapes, in the atypical-molded-body manufacturing device according to the third embodiment of the present invention.
Figure 25:
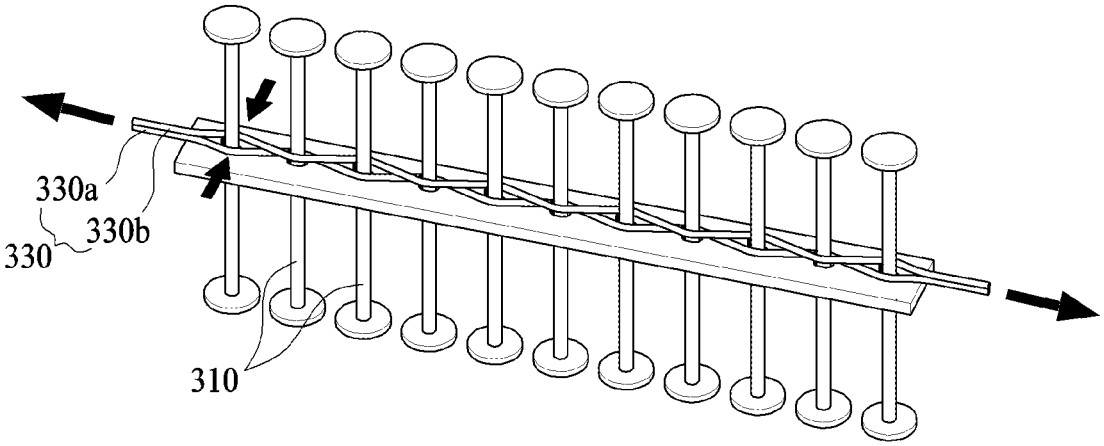
Figure 26:
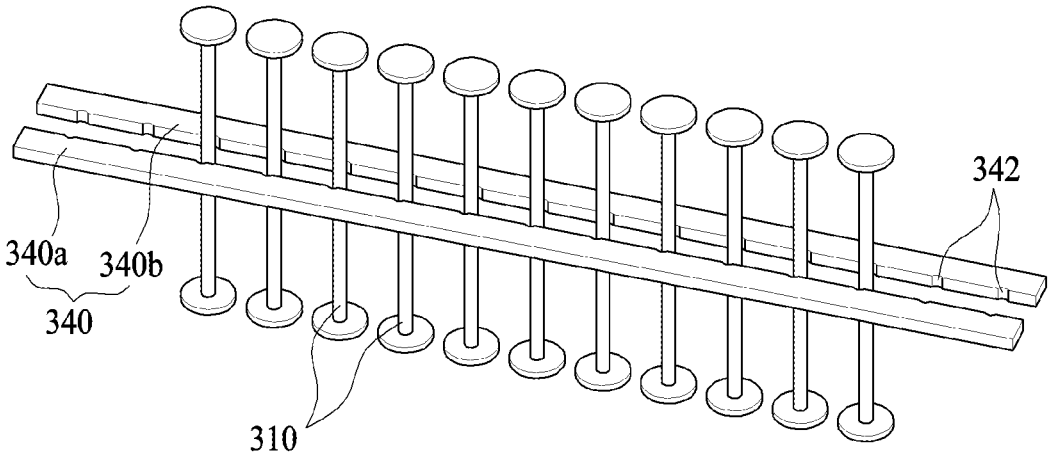

FIGS. 24 to 26 illustrate various shapes of anchoring parts 320, 330 and 340. They will be described below in detail.

First, as illustrated in FIG. 24, the anchoring part 320 includes a first anchoring member 320*a* and a second anchoring member 320*b*. The first anchoring member 320*a* is configured such that the plurality of auxiliary rods 310 arranged in the first direction pass there through, and is formed to be movable to one side. Further, the second anchoring member 320*b* is configured such that the auxiliary rods 310 passing through the first anchoring member 320*a* likewise pass there through, and is formed to be movable to the other side.

That is, the first anchoring member 320*a* and the second anchoring member 320*b* may be moved in opposing directions, thus allowing the auxiliary rods 310 to be anchored.

As illustrated in FIG. 25, the anchoring part 330 includes a first steel wire 330*a* that is aligned to pass through between the plurality of auxiliary rods 310 arranged in the first direction, and a second steel wire 330*b* that is likewise aligned to pass through between the plurality of auxiliary rods 310 arranged in the first direction for two of the steel wires 330*a* and 330*b* to cross against each other at each of the auxiliary rods 310.

In this case, as both ends of the first steel wire 330*a* and the second steel wire 330*b* are tensioned, the auxiliary rods 310 may be tightened. Thus, the auxiliary rods 310 may be anchored such that they are not moved.

As illustrated in FIG. 26, the anchoring part 340 includes a first moving member 340*a*, and a second moving member 340*b*. The first moving member 340*a* and the second moving member 340*b* are formed, respectively, to be long in the first direction, and are formed to adjust a separation distance between the plurality of auxiliary rods 310 arranged in the first direction. Further, the first moving member 340*a* and the second moving member 340*b* are provided on opposite sides, thus compressing and anchoring the auxiliary rods 310 when they are moved to the auxiliary rods 310.

As described above, the anchoring part of the rod-type mold 300 may be formed in various shapes. Various anchoring methods are possible, in addition to the methods illustrated in the respective drawings.

Figure 27:
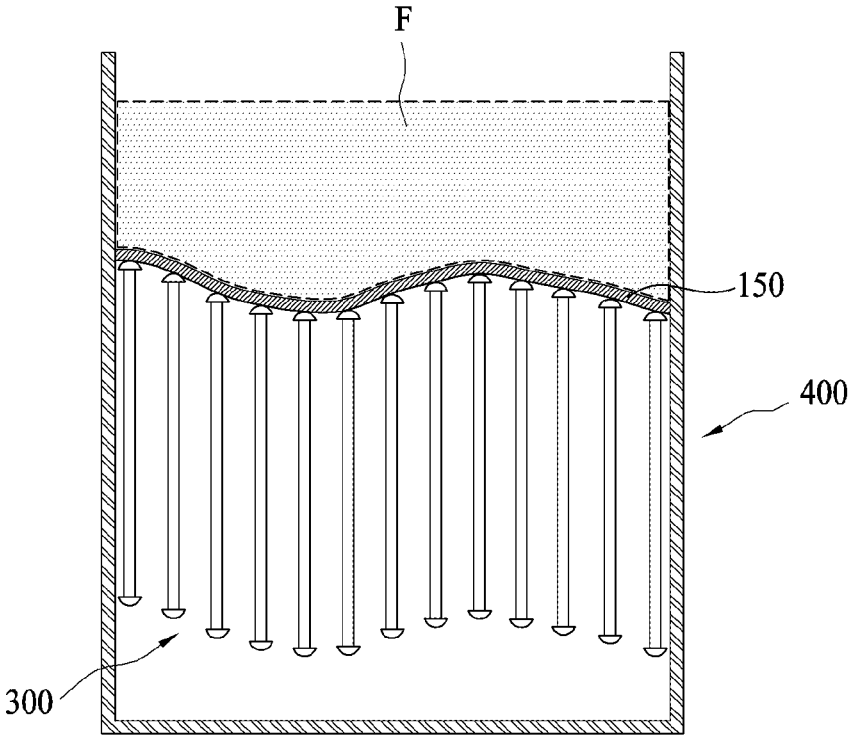
FIGS. 27 to 29 are sectional views illustrating a state in which an atypical molded body is formed using a rod-type mold, in the atypical-molded-body manufacturing device according to the third embodiment of the present invention.
Figure 28:
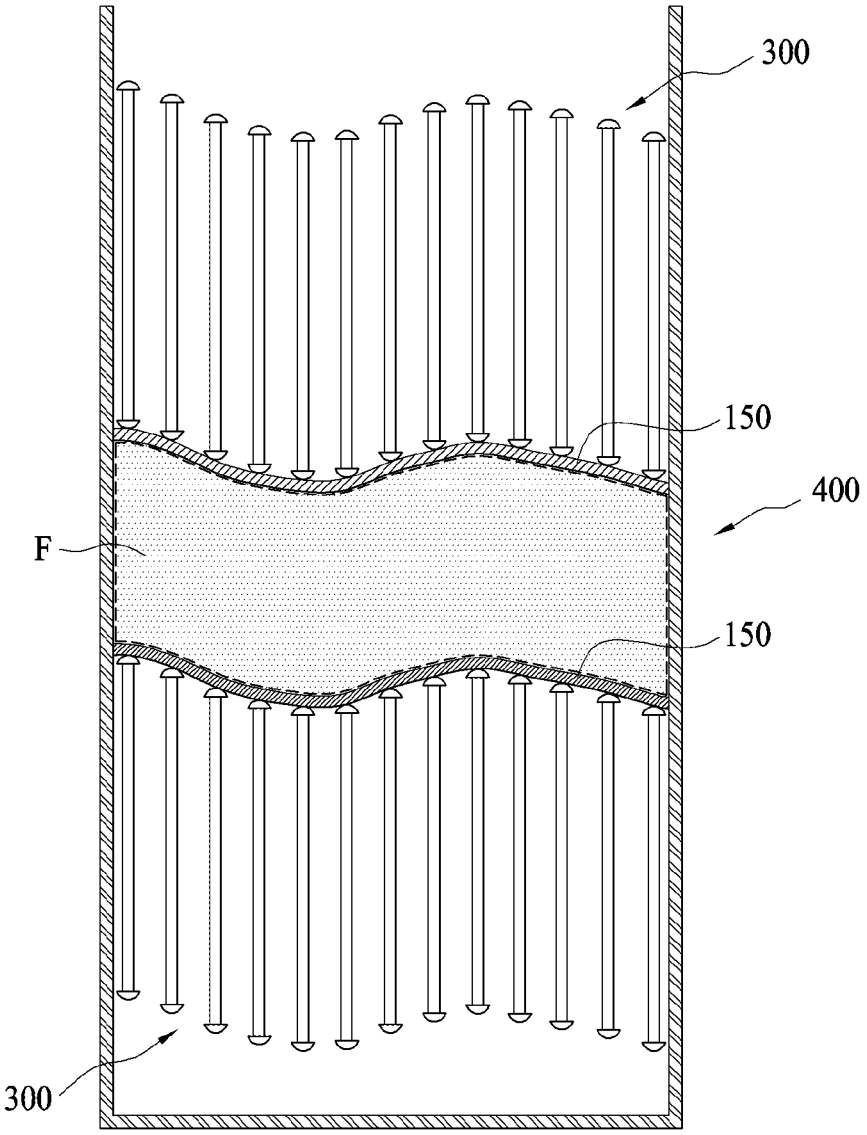
Figure 29:
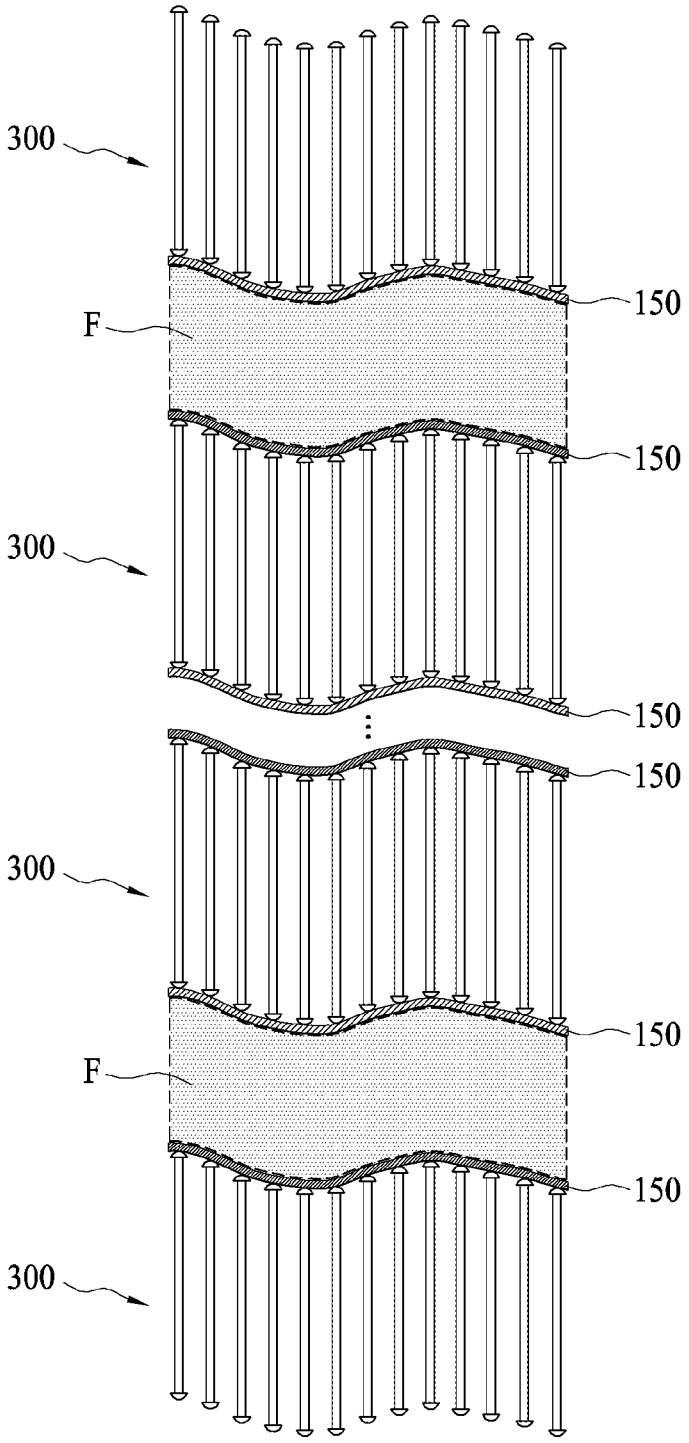

FIGS. 27 to 29 are sectional views illustrating a state in which the atypical molded body is formed using the rod-type mold 300, in the atypical-molded-body manufacturing device according to the third embodiment of the present invention.

As illustrated in FIG. 27, the deformation pad 150 is seated on the upper portion of the rod-type mold 300 having a predetermined atypical curvature, and the molding material F is injected into the mold 400, thus forming the molded body having the atypical curvature. As such, the rod-type mold 300 may be used as the base for forming the atypical molded body.

As illustrated in FIG. 28, a pair of rod-type molds 300 each having a predetermined atypical curvature is provided. Further, after the rod-type molds are located, respectively, in upper and lower portions of the mold 400, the deformation pads 150 are located in a lower portion of the rod-type mold 300 situated in the upper portion and located in an upper portion of the rod-type mold 300 situated in the lower portion.

Further, it is possible to form the molded body by injecting the molding material F between the pair of upper and lower rod-type molds 300. In this case, it is possible to manufacture the molded body of the atypical curvature having the same upper and lower surfaces.

Further, by applying the method as above, it is possible to prepare a desired number of rod-type molds 300 as illustrated in FIG. 29 and to inject the molding materials F between the molds, thus allowing a plurality of molded bodies to be simultaneously manufactured.

After the molding material that is melted or solidified as it absorbs or dissipates heat is injected into the mold and then is cooled, the molding material is solidified according to the shape of the deformation pad. Further, the solidified molding material is utilized as a curved surface-shaped mold to produce the concrete member.

While the present invention has been described with respect to the aforementioned embodiments, it will be apparent to those skilled in the art that various changes and modifications may be made without departing from the spirit and scope of the invention as defined in the following claims.

The invention claimed is:

1. An atypical-molded-body manufacturing device, comprising:

at least one shape output unit including:

a plurality of movable rods provided to be movable up and down, and arranged along a first direction, each movable rod having threads spirally formed on an outwardly facing circumferential surface of the movable rod, and a driving module transferring a driving force to the movable rods, thereby moving each of the plurality of movable rods to a predetermined height, the driving module comprising:

a plurality of main gears, each main gear provided to pass therethrough each of the plurality of movable rods, and each having a bore therethrough with internal threads formed to correspond to the threads of each movable rod, wherein rotation of each main gear moves the movable rod in translation relative to the main gear; and a main actuator transferring a driving force to rotate each main gear, thus moving each movable rod up and down, whereby an atypical curvature is formed by a difference in level configured by the upper end of each of the plurality of movable rods that have moved to the predetermined height.

2. The atypical-molded-body manufacturing device of claim 1, wherein the atypical-molded-body manufacturing device comprises at least two of the shape output units, and the plurality of movable rods of the at least two shape output units is arranged in a grid shape having a second direction that is perpendicular to the first direction.

3. The atypical-molded-body manufacturing device of claim 1, wherein the driving module further comprises:

an auxiliary gear provided between a pair of neighboring main gears; and an auxiliary actuator moving the auxiliary gear to cause the auxiliary gear to optionally engage with the main gear.

4. The atypical-molded-body manufacturing device of claim 1, wherein the main actuator transfers the driving force to any one among the main gears located at the outermost side.

5. The atypical-molded-body manufacturing device of claim 1, wherein the driving module further comprises:

an auxiliary gear provided to correspond to the main gear;

an auxiliary actuator moving the auxiliary gear to cause the auxiliary gear to optionally engage with the corresponding main gear; and a gear bar indirectly engaging with the main gear via the auxiliary gear, and the main actuator rotates the gear bar, thus transferring the driving force to the main gear.

6. The atypical-molded-body manufacturing device of claim 1 further comprising:

a fixing member fixing the movable rod to prevent the movable rod from being rotated.

7. The atypical-molded-body manufacturing device of claim 1, further comprising:

a first sensor provided on an upper portion of each of the movable rods to detect a height of the movable rod, and configured to measure a lowest height of the movable rod; and a second sensor provided on a lower portion of each of the movable rods to detect the height of the movable rod, and configured to measure a highest height of the movable rod.

8. The atypical-molded-body manufacturing device of claim 1, further comprising:

a frame through which the plurality of movable rods pass, the frame having a through hole formed to guide each of the movable rods and fixing the driving module.

9. The atypical-molded-body manufacturing device of claim 1, further comprising:

a deformation pad seated on the shape output unit, formed to have flexibility, and deformed as the movable rods move up and down, thus defining curvature.

10. The atypical-molded-body manufacturing device of claim 9, further comprising:

a cap member provided on the upper end of each of the movable rods, and increasing a contact surface with the deformation pad.

11. The atypical-molded-body manufacturing device of claim 1, further comprising:

an encoder for calculating height data of each of the movable rods.

* * * * *